US007966683B2

(12) United States Patent
Herkle et al.

(10) Patent No.: US 7,966,683 B2
(45) **Date of Patent: *Jun. 28, 2011**

(54) METHOD FOR OPERATING A STEAM GENERATOR IN A FABRIC TREATMENT APPLIANCE

(75) Inventors: Christoph Herkle, Schwäbisch Gmünd (DE); Thomas Benne, Schorndorf (DE); Robert Pöettger, Remshalden (DE); Markus Beck, Remseck (DE)

(73) Assignee: Whirlpool Corporation, Benton Harbor, MI (US)

( * ) Notice: Subject to any disclaimer, the term of this patent is extended or adjusted under 35 U.S.C. 154(b) by 691 days.

This patent is subject to a terminal disclaimer.

(21) Appl. No.: 11/848,546

(22) Filed: Aug. 31, 2007

(65) Prior Publication Data

US 2009/0056034 A1 Mar. 5, 2009

(51) Int. Cl.
*D06B 19/00* (2006.01)
*D06F 33/00* (2006.01)

(52) U.S. Cl. ..... 8/149.3; 8/158

(58) Field of Classification Search ..... 8/149.3, 8/158, 159

See application file for complete search history.

(56) References Cited

U.S. PATENT DOCUMENTS

| | | | |
|---|---|---|---|
| 369,609 | A | 9/1887 | Montanye |
| 382,289 | A | 5/1888 | Ballard |
| 480,037 | A | 8/1892 | Rowe et al. |
| 647,112 | A | 4/1900 | Pearson |
| 956,458 | A | 4/1910 | Walter |
| 1,089,334 | A | 3/1914 | Dickerson |
| 1,616,372 | A | 2/1927 | Janson |
| 1,676,763 | A | 7/1928 | Anetsberger et al. |
| 1,852,179 | A | 4/1932 | McDonald |
| 2,314,332 | A | 3/1943 | Ferris |
| 2,434,476 | A | 1/1948 | Wales |
| 2,778,212 | A | 1/1957 | Dayton et al. |
| 2,800,010 | A | 7/1957 | Dunn |
| 2,845,786 | A | 8/1958 | Chrisman |
| 2,881,609 | A | 4/1959 | Brucken |
| 2,937,516 | A | 5/1960 | Czaika |
| 2,966,052 | A | 12/1960 | Syles |
| 3,035,145 | A | 5/1962 | Rudolph |
| 3,060,713 | A | 10/1962 | Burkall |
| 3,223,108 | A | 12/1965 | Martz, Jr |

(Continued)

FOREIGN PATENT DOCUMENTS

| | | |
|---|---|---|
| CA | 1330526 | 7/1994 |

(Continued)

OTHER PUBLICATIONS

V-ZUG LTD Washing Machine Adora SL; User Manual; V-ZUG AG, CH-6301 Zug, 2004; V-ZUG LTD Industriestrasse 66, 6301 Zug, Tel. 041 767 67 67.

*Primary Examiner* — Joseph L Perrin

(74) *Attorney, Agent, or Firm* — Clifton G. Green; McGarry Bair PC

(57) ABSTRACT

A method of controlling the operation of a steam generator in a fabric treatment appliance may include setting an operational temperature for the steam generator based on calcification of the steam generator. A change in the calcification of the steam generator may be determined by behavior of the actual temperature of the steam generator in response to changing a flow rate of water supplied to the steam generator.

16 Claims, 15 Drawing Sheets

U.S. PATENT DOCUMENTS

| | | | |
|---|---|---|---|
| 3,234,571 | A | 2/1966 | Buss |
| 3,347,066 | A | 10/1967 | Klausner |
| 3,498,091 | A | 3/1970 | Mason |
| 3,550,170 | A | 12/1970 | Davis |
| 3,697,727 | A | 10/1972 | Neuman et al. |
| 3,707,855 | A | 1/1973 | Buckley |
| 3,712,089 | A | 1/1973 | Toth |
| 3,801,077 | A | 4/1974 | Pearson |
| 3,830,241 | A | 8/1974 | Dye et al. |
| 3,869,815 | A | 3/1975 | Bullock |
| 3,890,987 | A | 6/1975 | Marcussen et al. |
| 3,935,719 | A | 2/1976 | Henderson |
| 4,034,583 | A | 7/1977 | Miessler |
| 4,045,174 | A | 8/1977 | Fuhring et al. |
| 4,108,000 | A | 8/1978 | Norris |
| 4,177,928 | A | 12/1979 | Bergkvist |
| 4,207,683 | A | 6/1980 | Horton |
| 4,214,148 | A | 7/1980 | Fleischhauer |
| 4,263,258 | A | 4/1981 | Kalasek |
| 4,332,047 | A | 6/1982 | Kuttelwesch |
| 4,373,430 | A | 2/1983 | Allen |
| 4,386,509 | A | 6/1983 | Kuttelwesch |
| 4,432,111 | A | 2/1984 | Hoffmann et al. |
| 4,489,574 | A | 12/1984 | Spendel |
| 4,496,473 | A | 1/1985 | Sanderson |
| 4,527,343 | A | 7/1985 | Danneberg |
| 4,646,630 | A | 3/1987 | McCoy et al. |
| 4,761,305 | A | 8/1988 | Ochiai |
| 4,777,682 | A | 10/1988 | Dreher et al. |
| 4,784,666 | A | 11/1988 | Brenner et al. |
| 4,809,597 | A | 3/1989 | Lin |
| 4,879,887 | A | 11/1989 | Kagi et al. |
| 4,920,668 | A | 5/1990 | Henneberger et al. |
| 4,987,627 | A | 1/1991 | Cur et al. |
| 4,991,545 | A | 2/1991 | Rabe et al. |
| 5,032,186 | A | 7/1991 | Childers et al. |
| 5,050,259 | A | 9/1991 | Tsubaki et al. |
| 5,052,344 | A | 10/1991 | Kosugi et al. |
| 5,058,194 | A | 10/1991 | Violi |
| 5,063,609 | A | 11/1991 | Lorimer |
| 5,107,606 | A | 4/1992 | Tsubaki et al. |
| 5,146,693 | A | 9/1992 | Dottor et al. |
| 5,152,252 | A | 10/1992 | Bolton et al. |
| 5,154,197 | A | 10/1992 | Auld et al. |
| 5,172,654 | A | 12/1992 | Christiansen |
| 5,172,888 | A | 12/1992 | Ezekoye |
| 5,199,455 | A | 4/1993 | Dlouhy |
| 5,212,969 | A | 5/1993 | Tsubaki et al. |
| 5,219,370 | A | 6/1993 | Farrington et al. |
| 5,219,371 | A | 6/1993 | Shim et al. |
| 5,279,676 | A | 1/1994 | Oslin et al. |
| 5,291,758 | A | 3/1994 | Lee |
| 5,293,761 | A | 3/1994 | Jang |
| 5,315,727 | A | 5/1994 | Lee |
| 5,345,637 | A | 9/1994 | Pastryk et al. |
| 5,460,161 | A | 10/1995 | Englehart et al. |
| 5,570,626 | A | 11/1996 | Vos |
| 5,619,983 | A | 4/1997 | Smith |
| 5,727,402 | A | 3/1998 | Wada |
| 5,732,664 | A | 3/1998 | Badeaux, Jr. |
| 5,743,034 | A | 4/1998 | Debourg et al. |
| 5,758,377 | A | 6/1998 | Cimetta et al. |
| 5,768,730 | A | 6/1998 | Matsumoto et al. |
| 5,774,627 | A | 6/1998 | Jackson |
| 5,815,637 | A | 9/1998 | Allen et al. |
| 6,029,300 | A | 2/2000 | Kawaguchi et al. |
| 6,067,403 | A | 5/2000 | Morgandi |
| 6,094,523 | A | 7/2000 | Zelina et al. |
| 6,122,849 | A | 9/2000 | Kida et al. |
| 6,161,306 | A | 12/2000 | Clodic |
| 6,178,671 | B1 | 1/2001 | Zwanenburg et al. |
| 6,295,691 | B1 | 10/2001 | Chen |
| 6,327,730 | B1 | 12/2001 | Corbett |
| 6,434,857 | B1 | 8/2002 | Anderson et al. |
| 6,451,066 | B2 | 9/2002 | Estes et al. |
| 6,460,381 | B1 | 10/2002 | Yoshida et al. |
| 6,585,781 | B1 | 7/2003 | Roseen |
| 6,622,529 | B1 | 9/2003 | Crane |
| 6,647,931 | B1 | 11/2003 | Morgandi et al. |
| 6,691,536 | B2 | 2/2004 | Severns et al. |
| 6,772,751 | B2 | 8/2004 | Deuringer et al. |
| 6,789,404 | B2 | 9/2004 | Kim et al. |
| 6,823,878 | B1 | 11/2004 | Gadini |
| 6,874,191 | B2 | 4/2005 | Kim et al. |
| 6,889,399 | B2 | 5/2005 | Steiner et al. |
| 7,021,087 | B2 | 4/2006 | France et al. |
| 7,096,828 | B2 | 8/2006 | Tippmann |
| 7,290,412 | B2 | 11/2007 | Yang et al. |
| 7,325,330 | B2 | 2/2008 | Kim et al. |
| 7,404,304 | B2 | 7/2008 | Yang et al. |
| 7,421,752 | B2 | 9/2008 | Donadon et al. |
| 7,476,369 | B2 | 1/2009 | Yin et al. |
| 7,490,491 | B2 | 2/2009 | Yang et al. |
| 7,490,493 | B2 | 2/2009 | Kim et al. |
| 7,520,146 | B2 | 4/2009 | Kim et al. |
| 7,600,402 | B2 | 10/2009 | Shin et al. |
| 7,765,628 | B2 | 8/2010 | Wong et al. |
| 2001/0032599 | A1 | 10/2001 | Fischer et al. |
| 2003/0215226 | A1 | 11/2003 | Nomura et al. |
| 2003/0226999 | A1 | 12/2003 | Hage |
| 2004/0163184 | A1 | 8/2004 | Waldron et al. |
| 2004/0187527 | A1 | 9/2004 | Kim et al. |
| 2004/0187529 | A1 | 9/2004 | Kim et al. |
| 2004/0200093 | A1 | 10/2004 | Wunderlin et al. |
| 2004/0206480 | A1 | 10/2004 | Maydanik et al. |
| 2004/0221474 | A1 | 11/2004 | Slutsky et al. |
| 2004/0237603 | A1 | 12/2004 | Kim et al. |
| 2004/0244432 | A1 | 12/2004 | Kim et al. |
| 2004/0244438 | A1 | 12/2004 | North |
| 2004/0255391 | A1 | 12/2004 | Kim et al. |
| 2005/0000031 | A1 | 1/2005 | Price et al. |
| 2005/0028297 | A1 | 2/2005 | Kim et al. |
| 2005/0034248 | A1 | 2/2005 | Oh et al. |
| 2005/0034249 | A1 | 2/2005 | Oh et al. |
| 2005/0034250 | A1 | 2/2005 | Oh et al. |
| 2005/0034487 | A1 | 2/2005 | Oh et al. |
| 2005/0034488 | A1 | 2/2005 | Oh et al. |
| 2005/0034489 | A1 | 2/2005 | Oh et al. |
| 2005/0034490 | A1 | 2/2005 | Oh et al. |
| 2005/0050644 | A1 | 3/2005 | Severns et al. |
| 2005/0072382 | A1 | 4/2005 | Tippmann, Sr. |
| 2005/0072383 | A1 | 4/2005 | Powell et al. |
| 2005/0092035 | A1 | 5/2005 | Shin et al. |
| 2005/0132503 | A1 | 6/2005 | Yang et al. |
| 2005/0132504 | A1 | 6/2005 | Yang et al. |
| 2005/0132756 | A1 | 6/2005 | Yang et al. |
| 2005/0144734 | A1 | 7/2005 | Yang et al. |
| 2005/0144735 | A1 | 7/2005 | Yang et al. |
| 2005/0205482 | A1 | 9/2005 | Gladney |
| 2005/0220672 | A1 | 10/2005 | Takahashi et al. |
| 2005/0223503 | A1 | 10/2005 | Hong et al. |
| 2005/0223504 | A1 | 10/2005 | Lee et al. |
| 2005/0252250 | A1 | 11/2005 | Oh et al. |
| 2005/0262644 | A1 | 12/2005 | Oak et al. |
| 2005/0284194 | A1 | 12/2005 | Kim et al. |
| 2006/0000242 | A1 | 1/2006 | Yang et al. |
| 2006/0001612 | A1 | 1/2006 | Kim |
| 2006/0005581 | A1 | 1/2006 | Banba |
| 2006/0010613 | A1 | 1/2006 | Jeon et al. |
| 2006/0010727 | A1 | 1/2006 | Fung |
| 2006/0010937 | A1 | 1/2006 | Kim et al. |
| 2006/0016020 | A1 | 1/2006 | Park |
| 2006/0090524 | A1 | 5/2006 | Jeon et al. |
| 2006/0096333 | A1 | 5/2006 | Park et al. |
| 2006/0101586 | A1 | 5/2006 | Park et al. |
| 2006/0101588 | A1 | 5/2006 | Park et al. |
| 2006/0101867 | A1 | 5/2006 | Kleker |
| 2006/0107468 | A1 | 5/2006 | Urbanet et al. |
| 2006/0112585 | A1 | 6/2006 | Choi et al. |
| 2006/0117596 | A1 | 6/2006 | Kim et al. |
| 2006/0130354 | A1 | 6/2006 | Choi et al. |
| 2006/0137105 | A1 | 6/2006 | Hong et al. |
| 2006/0137107 | A1 | 6/2006 | Lee et al. |
| 2006/0150689 | A1 | 7/2006 | Kim et al. |
| 2006/0151005 | A1 | 7/2006 | Kim et al. |
| 2006/0151009 | A1 | 7/2006 | Kim et al. |
| 2006/0191077 | A1* | 8/2006 | Oh et al. ..... 8/158 |

| | | | | |
|---|---|---|---|---|
| 2006/0191078 | A1 | 8/2006 | Kim et al. | |
| 2006/0277690 | A1 | 12/2006 | Pyo et al. | |
| 2007/0006484 | A1 | 1/2007 | Moschuetz et al. | |
| 2007/0028398 | A1 | 2/2007 | Kwon et al. | |
| 2007/0084000 | A1 | 4/2007 | Bernardino et al. | |
| 2007/0101773 | A1 | 5/2007 | Park et al. | |
| 2007/0107472 | A1 | 5/2007 | Kim et al. | |
| 2007/0107884 | A1 | 5/2007 | Sirkar et al. | |
| 2007/0125133 | A1 | 6/2007 | Oh et al. | |
| 2007/0130697 | A1 | 6/2007 | Oh et al. | |
| 2007/0130698 | A1 | 6/2007 | Kim | |
| 2007/0136956 | A1 | 6/2007 | Kim et al. | |
| 2007/0137262 | A1 | 6/2007 | Kim et al. | |
| 2007/0169279 | A1 | 7/2007 | Park et al. | |
| 2007/0169280 | A1 | 7/2007 | Kim et al. | |
| 2007/0169282 | A1 | 7/2007 | Kim | |
| 2007/0169521 | A1 | 7/2007 | Kim et al. | |
| 2007/0180628 | A1 | 8/2007 | Ahn | |
| 2007/0186591 | A1 | 8/2007 | Kim et al. | |
| 2007/0186592 | A1 | 8/2007 | Kim et al. | |
| 2007/0186593 | A1 | 8/2007 | Ahn | |
| 2007/0199353 | A1 | 8/2007 | Woo et al. | |
| 2007/0240458 | A1 | 10/2007 | Kim et al. | |
| 2007/0283505 | A1 | 12/2007 | Wong et al. | |
| 2007/0283508 | A1 | 12/2007 | Wong et al. | |
| 2007/0283509 | A1* | 12/2007 | Wong et al. | 8/149.3 |
| 2007/0283728 | A1 | 12/2007 | Wong et al. | |
| 2008/0006063 | A1 | 1/2008 | Ahn et al. | |
| 2008/0019864 | A1 | 1/2008 | Savage et al. | |
| 2008/0028801 | A1 | 2/2008 | Czyzewski et al. | |
| 2008/0115740 | A1 | 5/2008 | You | |
| 2009/0056034 | A1* | 3/2009 | Herkle et al. | 8/149.3 |
| 2009/0056036 | A1* | 3/2009 | Herkle et al. | 8/149.3 |
| 2009/0056762 | A1* | 3/2009 | Pinkowski et al. | 134/22.15 |

FOREIGN PATENT DOCUMENTS

| | | | |
|---|---|---|---|
| CN | 1664222 | A | 9/2005 |
| CN | 1962988 | A | 5/2007 |
| CN | 1962998 | A | 5/2007 |
| CN | 1965123 | A | 5/2007 |
| CN | 101003939 | A | 7/2007 |
| CN | 101008148 | A | 8/2007 |
| CN | 101024915 | A | 8/2007 |
| DE | 12203 | | 2/1881 |
| DE | 42920 | | 4/1888 |
| DE | 69929 | | 8/1893 |
| DE | 132104 | | 7/1902 |
| DE | 176355 | | 10/1906 |
| DE | 243328 | | 2/1912 |
| DE | 283533 | | 4/1915 |
| DE | 317887 | | 1/1920 |
| DE | 427025 | | 3/1926 |
| DE | 435088 | | 10/1926 |
| DE | 479594 | | 7/1929 |
| DE | 668963 | | 12/1938 |
| DE | 853433 | | 10/1952 |
| DE | 894685 | | 10/1953 |
| DE | 1847016 | | 2/1962 |
| DE | 1873622 | | 6/1963 |
| DE | 2202345 | | 8/1973 |
| DE | 2226373 | | 12/1973 |
| DE | 2245532 | | 3/1974 |
| DE | 7340082 | | 5/1975 |
| DE | 2410107 | | 9/1975 |
| DE | 2533759 | | 2/1977 |
| DE | 3103529 | A1 | 8/1982 |
| DE | 3139466 | A1 | 4/1983 |
| DE | 3408136 | | 9/1985 |
| DE | 3501008 | A1 | 7/1986 |
| DE | 3627988 | | 4/1987 |
| DE | 8703344 | | 8/1988 |
| DE | 4116673 | A1 | 11/1992 |
| DE | 4225847 | | 2/1994 |
| DE | 4413213 | | 10/1995 |
| DE | 4443338 | | 6/1996 |
| DE | 29707168 | | 7/1997 |
| DE | 19730422 | A1 | 1/1999 |
| DE | 19736794 | A1 | 2/1999 |
| DE | 19742282 | | 2/1999 |
| DE | 19743508 | | 4/1999 |
| DE | 19751028 | | 5/1999 |
| DE | 19903951 | | 8/2000 |
| DE | 10028944 | | 12/2001 |
| DE | 10035904 | | 1/2002 |
| DE | 10039904 | | 2/2002 |
| DE | 10043165 | | 2/2002 |
| DE | 10312163 | | 11/2003 |
| DE | 10260163 | A1 | 7/2004 |
| DE | 102005051721 | A1 | 5/2007 |
| DE | 102007023020 | B3 | 5/2008 |
| EP | 0043122 | | 1/1982 |
| EP | 0132884 | | 2/1985 |
| EP | 0135484 | A2 | 3/1985 |
| EP | 0217981 | | 4/1987 |
| EP | 0222264 | | 5/1987 |
| EP | 0280782 | | 9/1988 |
| EP | 0284554 | | 9/1988 |
| EP | 0287990 | | 10/1988 |
| EP | 0302125 | | 8/1989 |
| EP | 363708 | | 4/1990 |
| EP | 0383327 | | 8/1990 |
| EP | 0404253 | A1 | 12/1990 |
| EP | 0511525 | | 11/1992 |
| EP | 0574341 | A1 | 12/1993 |
| EP | 0582092 | A1 | 2/1994 |
| EP | 0638684 | A1 | 2/1995 |
| EP | 0672377 | A1 | 9/1995 |
| EP | 0726349 | A2 | 8/1996 |
| EP | 0768059 | | 4/1997 |
| EP | 0785303 | A1 | 7/1997 |
| EP | 0808936 | | 11/1997 |
| EP | 0821096 | A1 | 1/1998 |
| EP | 0839943 | A1 | 5/1998 |
| EP | 0816550 | | 7/1998 |
| EP | 1163387 | | 12/2001 |
| EP | 1275767 | A1 | 4/2002 |
| EP | 1275767 | | 1/2003 |
| EP | 1351016 | | 10/2003 |
| EP | 1411163 | | 4/2004 |
| EP | 1437547 | | 7/2004 |
| EP | 1441059 | | 7/2004 |
| EP | 1441175 | | 7/2004 |
| EP | 1464750 | | 10/2004 |
| EP | 1464751 | | 10/2004 |
| EP | 1469120 | | 10/2004 |
| EP | 1505193 | A2 | 2/2005 |
| EP | 1507028 | | 2/2005 |
| EP | 1507029 | | 2/2005 |
| EP | 1507030 | | 2/2005 |
| EP | 1507031 | | 2/2005 |
| EP | 1507032 | | 2/2005 |
| EP | 1507033 | | 2/2005 |
| EP | 1529875 | | 5/2005 |
| EP | 1544345 | | 6/2005 |
| EP | 1548175 | | 6/2005 |
| EP | 1659205 | A2 | 6/2005 |
| EP | 1550760 | | 7/2005 |
| EP | 1555338 | | 7/2005 |
| EP | 1555340 | | 7/2005 |
| EP | 1561853 | | 8/2005 |
| EP | 1584728 | | 10/2005 |
| EP | 1619284 | A1 | 1/2006 |
| EP | 1655408 | A1 | 5/2006 |
| EP | 1666655 | A2 | 6/2006 |
| EP | 1681384 | A1 | 7/2006 |
| EP | 1696066 | A2 | 8/2006 |
| EP | 1731840 | | 12/2006 |
| EP | 1746197 | A2 | 1/2007 |
| EP | 1783262 | A2 | 5/2007 |
| EP | 1555339 | | 8/2007 |
| EP | 1813704 | A1 | 8/2007 |
| EP | 1813709 | A2 | 8/2007 |
| EP | 1865099 | A1 | 12/2007 |
| EP | 1865101 | A1 | 12/2007 |
| EP | 1889966 | A2 | 2/2008 |
| EP | 1936023 | A1 | 6/2008 |
| FR | 2306400 | | 10/1976 |
| FR | 2525645 | A1 | 10/1983 |

| | | | |
|---|---|---|---|
| FR | 2581442 | | 11/1986 |
| FR | 2688807 | A1 | 9/1993 |
| GB | 10423 | | 0/1909 |
| GB | 21024 | | 0/1910 |
| GB | 21286 | | 0/1898 |
| GB | 191010567 | A | 4/1911 |
| GB | 191010792 | A | 4/1911 |
| GB | 191022943 | A | 8/1911 |
| GB | 191024005 | A | 10/1911 |
| GB | 191103554 | A | 12/1911 |
| GB | 102466 | A | 12/1916 |
| GB | 285384 | A | 11/1928 |
| GB | 397236 | | 8/1933 |
| GB | 514440 | A | 11/1939 |
| GB | 685813 | | 1/1953 |
| GB | 799788 | | 8/1958 |
| GB | 835250 | | 5/1960 |
| GB | 881083 | | 11/1961 |
| GB | 889500 | A | 2/1962 |
| GB | 1155268 | A | 6/1969 |
| GB | 1331623 | | 9/1973 |
| GB | 1352955 | | 5/1974 |
| GB | 1366852 | A | 9/1974 |
| GB | 2219603 | A | 12/1989 |
| GB | 2309071 | A | 7/1997 |
| GB | 2348213 | | 9/2000 |
| JP | 35021275 | | 8/1950 |
| JP | 36023044 | | 9/1960 |
| JP | 36000067 | | 7/1961 |
| JP | 52146973 | | 12/1977 |
| JP | 54068072 | A | 5/1979 |
| JP | 57094480 | | 6/1982 |
| JP | 57032858 | | 7/1982 |
| JP | 60138399 | | 7/1985 |
| JP | 61128995 | | 6/1986 |
| JP | 62066891 | | 3/1987 |
| JP | 2049700 | A | 2/1990 |
| JP | 02161997 | | 6/1990 |
| JP | 02026465 | | 7/1990 |
| JP | 02198595 | | 8/1990 |
| JP | 2239894 | | 9/1990 |
| JP | 2242088 | A | 9/1990 |
| JP | 02267402 | | 11/1990 |
| JP | 03025748 | | 6/1991 |
| JP | 3137401 | A | 6/1991 |
| JP | 4020396 | A | 1/1992 |
| JP | 04158896 | | 6/1992 |
| JP | 4158896 | A | 6/1992 |
| JP | 05023493 | | 2/1993 |
| JP | 05115672 | A | 5/1993 |
| JP | 05146583 | | 6/1993 |
| JP | 05269294 | | 10/1993 |
| JP | 5346485 | A | 12/1993 |
| JP | 06123360 | | 5/1994 |
| JP | 08261689 | | 10/1996 |
| JP | 9133305 | A | 5/1997 |
| JP | 10235088 | A | 9/1998 |
| JP | 11047488 | | 2/1999 |
| JP | 11164979 | | 6/1999 |
| JP | 11164980 | | 6/1999 |
| JP | 11226290 | | 8/1999 |
| JP | 2000176192 | | 6/2000 |
| JP | 2003019382 | | 1/2003 |
| JP | 2003093775 | | 4/2003 |
| JP | 2003311068 | | 11/2003 |
| JP | 2003311084 | | 11/2003 |
| JP | 2003320324 | | 11/2003 |
| JP | 2003326077 | | 11/2003 |
| JP | 2004061011 | A | 2/2004 |
| JP | 2004121666 | | 4/2004 |
| JP | 2004167131 | | 6/2004 |
| JP | 2004298614 | | 10/2004 |
| JP | 2004298616 | | 10/2004 |
| JP | 2004313793 | | 11/2004 |
| JP | 2005058740 | | 3/2005 |
| JP | 2005058741 | | 3/2005 |
| JP | 2005177440 | | 7/2005 |
| JP | 2005177445 | | 7/2005 |
| JP | 2005177450 | | 7/2005 |
| JP | 2005192997 | | 7/2005 |
| JP | 2005193003 | | 7/2005 |
| JP | 2006109886 | | 4/2006 |
| JP | 2006130295 | A | 5/2006 |
| KR | 9319820 | | 9/1993 |
| KR | 1019950018856 | | 7/1995 |
| KR | 1019970011098 | | 3/1997 |
| KR | 1019970070295 | | 11/1997 |
| KR | 2019970039170 | | 7/1998 |
| KR | 200128631 | | 8/1998 |
| KR | 100146947 | | 10/1998 |
| KR | 20010015043 | | 2/2001 |
| KR | 10220010010111 | | 2/2001 |
| KR | 20040085509 | A | 10/2004 |
| KR | 20050017481 | A | 2/2005 |
| KR | 20060031165 | | 4/2006 |
| WO | 9214954 | | 9/1992 |
| WO | 9307798 | A1 | 4/1993 |
| WO | 93/19237 | A1 | 9/1993 |
| WO | 9715709 | | 5/1997 |
| WO | 9803175 | | 1/1998 |
| WO | 0111134 | | 2/2001 |
| WO | 0174129 | A2 | 10/2001 |
| WO | 03012185 | | 2/2003 |
| WO | 03012185 | A2 | 2/2003 |
| WO | 03057966 | | 7/2003 |
| WO | 2004059070 | | 7/2004 |
| WO | 2004091359 | A2 | 10/2004 |
| WO | 2005001189 | A1 | 1/2005 |
| WO | 2005018837 | A1 | 3/2005 |
| WO | 2005115095 | | 12/2005 |
| WO | 2006001612 | | 1/2006 |
| WO | 2006009364 | A1 | 1/2006 |
| WO | 2006/070317 | A1 | 7/2006 |
| WO | 2006090973 | | 8/2006 |
| WO | 2006091054 | | 8/2006 |
| WO | 2006091057 | A1 | 8/2006 |
| WO | 2006098571 | | 9/2006 |
| WO | 2006098572 | | 9/2006 |
| WO | 2006098573 | | 9/2006 |
| WO | 2006101304 | | 9/2006 |
| WO | 2006101312 | | 9/2006 |
| WO | 2006101336 | | 9/2006 |
| WO | 2006101345 | | 9/2006 |
| WO | 2006101358 | | 9/2006 |
| WO | 2006101360 | | 9/2006 |
| WO | 2006101361 | | 9/2006 |
| WO | 2006101362 | | 9/2006 |
| WO | 2006101363 | | 9/2006 |
| WO | 2006101365 | | 9/2006 |
| WO | 2006101372 | | 9/2006 |
| WO | 2006101376 | | 9/2006 |
| WO | 2006101377 | | 9/2006 |
| WO | 2006104310 | | 10/2006 |
| WO | 2006112611 | | 10/2006 |
| WO | 2006126778 | A1 | 11/2006 |
| WO | 2006126779 | A1 | 11/2006 |
| WO | 2006126799 | A2 | 11/2006 |
| WO | 2006126803 | A2 | 11/2006 |
| WO | 2006126804 | A2 | 11/2006 |
| WO | 2006126810 | A2 | 11/2006 |
| WO | 2006126811 | A2 | 11/2006 |
| WO | 2006126813 | A2 | 11/2006 |
| WO | 2006126815 | A2 | 11/2006 |
| WO | 2006129912 | A1 | 12/2006 |
| WO | 2006129913 | A1 | 12/2006 |
| WO | 2006129915 | A1 | 12/2006 |
| WO | 2006129916 | A1 | 12/2006 |
| WO | 2007/007241 | A1 | 1/2007 |
| WO | 2007004785 | A1 | 1/2007 |
| WO | 2007010327 | A1 | 1/2007 |
| WO | 2007024050 | A1 | 3/2007 |
| WO | 2007024056 | A1 | 3/2007 |
| WO | 2007024057 | A1 | 3/2007 |
| WO | 2007026989 | A1 | 3/2007 |
| WO | 2007026990 | A1 | 3/2007 |
| WO | 2007055475 | A1 | 5/2007 |
| WO | 2007055510 | A1 | 5/2007 |
| WO | 2007058477 | A1 | 5/2007 |

| | | | |
|---|---|---|---|
| WO | 2007073012 | A1 | 6/2007 |
| WO | 2007073013 | A1 | 6/2007 |
| WO | 2007081069 | A1 | 7/2007 |
| WO | 2007086672 | A1 | 8/2007 |
| WO | 2007/116255 | A1 | 10/2007 |
| WO | 2007145448 | A2 | 12/2007 |
| WO | 2008004801 | A2 | 1/2008 |

* cited by examiner

METHOD FOR OPERATING A STEAM GENERATOR IN A FABRIC TREATMENT APPLIANCE

BACKGROUND OF THE INVENTION

1. Field of the Invention

The invention relates to operating a steam generator in a fabric treatment appliance.

2. Description of the Related Art

Some fabric treatment appliances, such as a washing machine, a clothes dryer, and a fabric refreshing or revitalizing machine, use steam generators for various reasons. The steam from the steam generator can be used to, for example, heat water, heat a load of fabric items and any water absorbed by the fabric items, dewrinkle fabric items, remove odors from fabric items, sanitize the fabric items, and sanitize components of the fabric treatment appliance.

A common problem associated with steam generators involves the formation of deposits, such as scale and sludge, within the steam generation chamber. Water supplies for many households may contain dissolved substances, such as calcium and magnesium, which can lead to the formation of deposits in the steam generation chamber when the water is heated. Scale and sludge are, respectively, hard and soft deposits; in some conditions, the hard scale tends to deposit on the inner walls of the structure forming the steam generation chamber, and the soft sludge can settle to the bottom of the steam generator. Formation of scale and sludge can detrimentally affect heat transfer and thereby decrease the steam generating efficiency of the steam generator (i. e., energy or heat input compared to resulting steam output). Further, scale and sludge can hinder fluid and steam flow through and out of the steam generator and can lead to a reduced operational life of the heater or steam generator.

SUMMARY OF THE INVENTION

A method according to one embodiment of the invention of controlling the operation of a steam generator in a fabric treatment appliance comprises setting an operational temperature for the steam generator based on calcification of the steam generator.

DESCRIPTION OF EMBODIMENTS OF THE INVENTION

Figure 1:
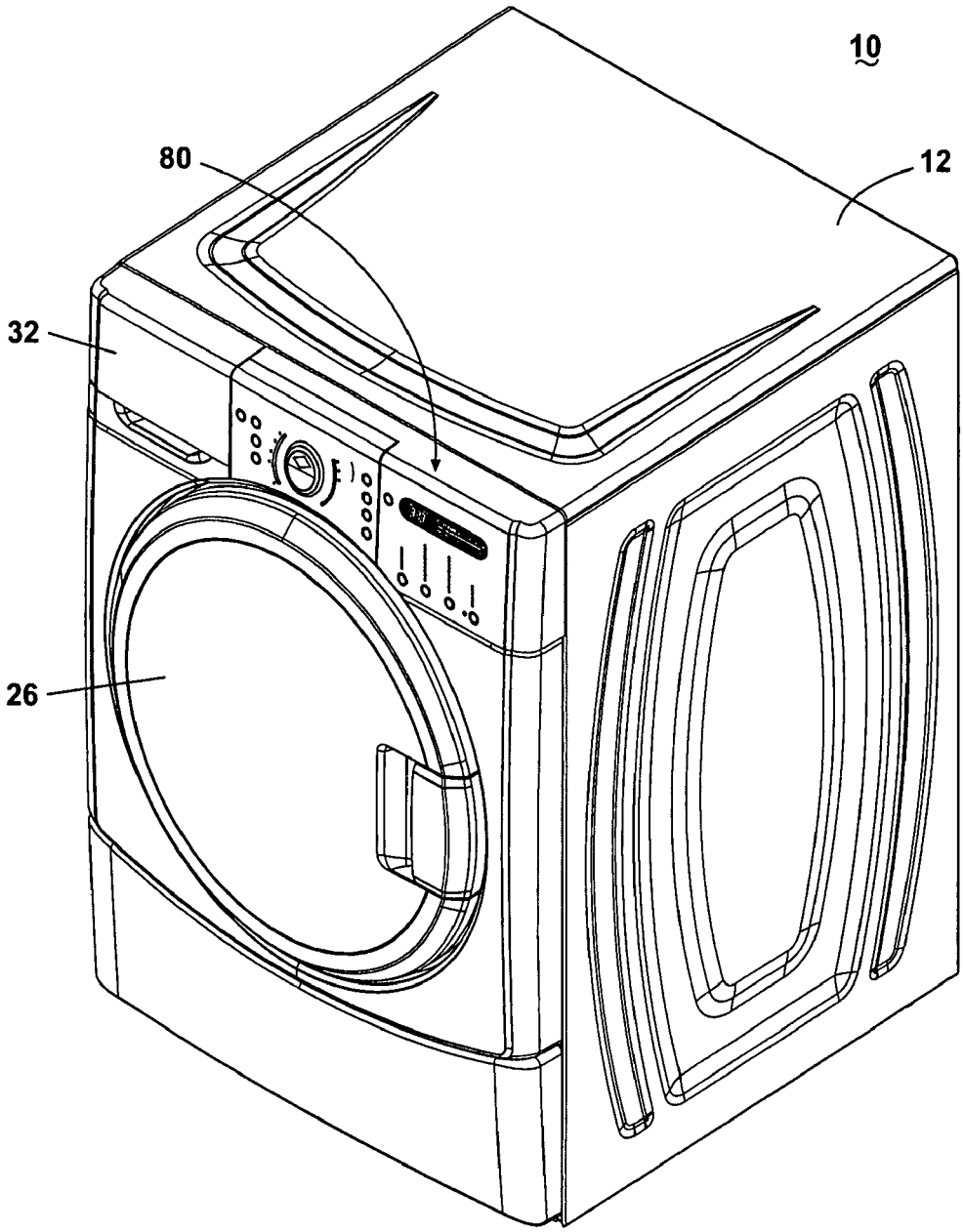
FIG. 1 is a perspective view of an exemplary fabric treatment appliance in the form of a washing machine according to one embodiment of the invention.

Referring now to the figures, FIG. 1 is a schematic view of an exemplary fabric treatment appliance in the form of a washing machine 10 according to one embodiment of the invention. The fabric treatment appliance may be any machine that treats fabrics, and examples of the fabric treatment appliance may include, but are not limited to, a washing machine, including top-loading, front-loading, vertical axis, and horizontal axis washing machines; a dryer, such as a tumble dryer or a stationary dryer, including top-loading dryers and front-loading dryers; a combination washing machine and dryer; a tumbling or stationary refreshing/revitalizing machine; an extractor; a non-aqueous washing apparatus; and a revitalizing machine. For illustrative purposes, the invention will be described with respect to a washing machine with the fabric being a clothes load, with it being understood that the invention may be adapted for use with any type of fabric treatment appliance for treating fabric and to other appliances, such as dishwashers, irons, and cooking appliances, including ovens, food steamers, and microwave ovens, employing a steam generator.

Figure 2:
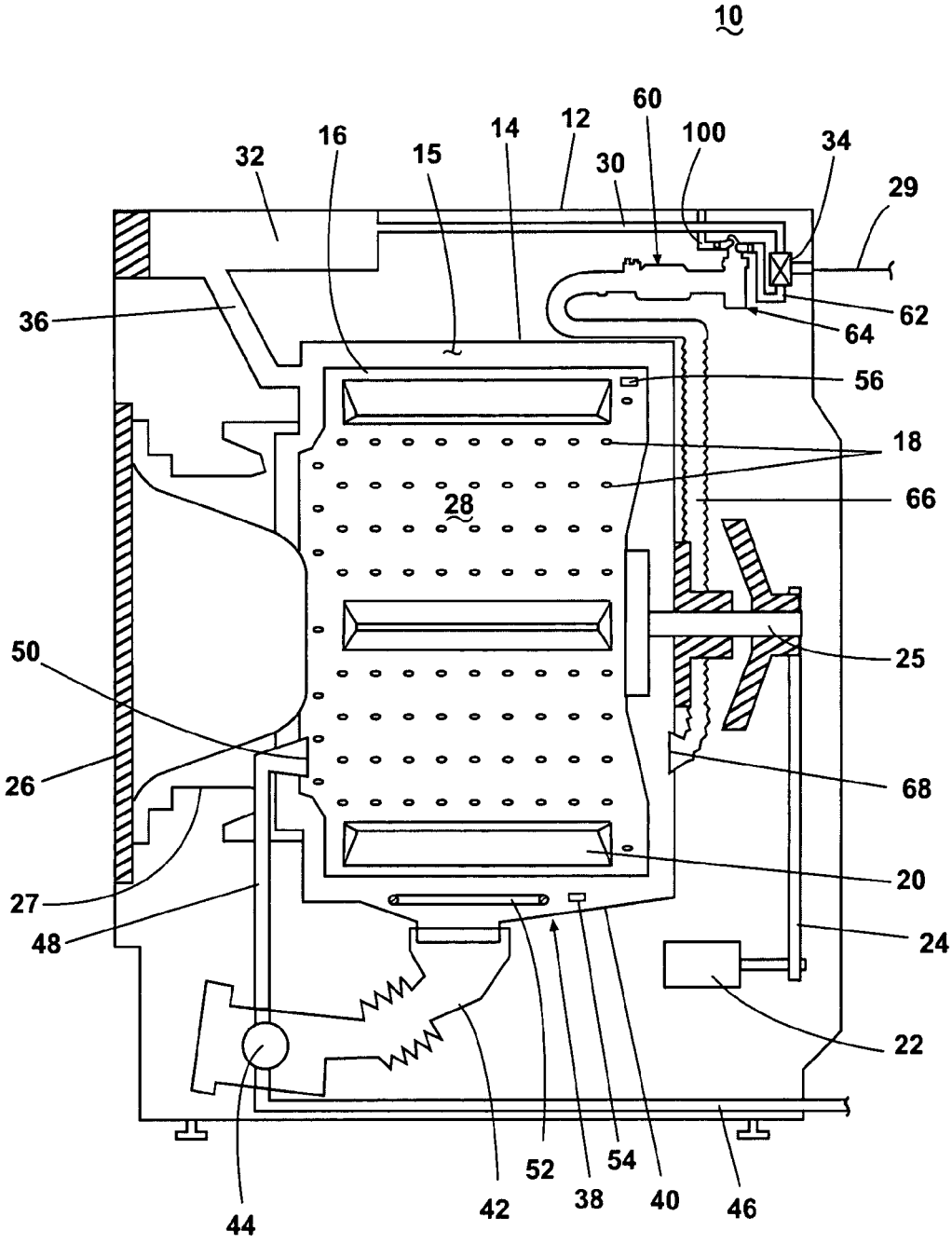
FIG. 2 is a schematic view of the fabric treatment appliance of FIG. 1.

FIG. 2 provides a schematic view of the fabric treatment appliance of FIG. 1. The washing machine 10 of the illustrated embodiment may include a cabinet 12 that houses a stationary tub 14, which defines an interior chamber 15. A rotatable drum 16 mounted within the interior chamber 15 of the tub 14 may include a plurality of perforations 18, and liquid may flow between the tub 14 and the drum 16 through the perforations 18. The drum 16 may further include a plurality of baffles 20 disposed on an inner surface of the drum 16 to lift fabric items contained in the drum 16 while the drum 16 rotates, as is well known in the washing machine art. A motor 22 coupled to the drum 16 through a belt 24 and a drive shaft 25 may rotate the drum 16. Alternately, the motor 22 may be directly coupled with the drive shaft 25 as is known in the art. Both the tub 14 and the drum 16 may be selectively closed by a door 26. A bellows 27 couples an open face of the tub 14 with the cabinet 12, and the door 26 seals against the bellows 27 when the door 26 closes the tub 14. The drum 16 may define a cleaning chamber 28 for receiving fabric items to be cleaned.

The tub 14 and/or the drum 16 may be considered a receptacle, and the receptacle may define a treatment chamber for receiving fabric items to be treated. While the illustrated washing machine 10 includes both the tub 14 and the drum 16, it is within the scope of the invention for the fabric treatment appliance to include only one receptacle, with the receptacle defining the treatment chamber for receiving the fabric items to be treated.

Washing machines are typically categorized as either a vertical axis washing machine or a horizontal axis washing machine. As used herein, the "vertical axis" washing machine refers to a washing machine having a rotatable drum that rotates about a generally vertical axis relative to a surface that supports the washing machine. Typically, the drum is perforate or imperforate and holds fabric items and a fabric moving element, such as an agitator, impeller, nutator, and the like, that induces movement of the fabric items to impart mechanical energy to the fabric articles for cleaning action. However, the rotational axis need not be vertical. The drum can rotate about an axis inclined relative to the vertical axis. As used herein, the "horizontal axis" washing machine refers to a washing machine having a rotatable drum that rotates about a generally horizontal axis relative to a surface that supports the washing machine. The drum may be perforated or imperforate, holds fabric items, and typically washes the fabric items by the fabric items rubbing against one another and/or hitting the surface of the drum as the drum rotates. In horizontal axis washing machines, the clothes are lifted by the rotating drum and then fall in response to gravity to form a tumbling action that imparts the mechanical energy to the fabric articles. In some horizontal axis washing machines, the drum rotates about a horizontal axis generally parallel to a surface that supports the washing machine. However, the rotational axis need not be horizontal. The drum can rotate about an axis inclined relative to the horizontal axis, with fifteen degrees of inclination being one example of inclination.

Vertical axis and horizontal axis machines are best differentiated by the manner in which they impart mechanical energy to the fabric articles. In vertical axis machines, the fabric moving element moves within a drum to impart mechanical energy directly to the clothes or indirectly through wash liquid in the drum. The clothes mover is typically moved in a reciprocating rotational movement. In horizontal axis machines mechanical energy is imparted to the clothes by the tumbling action formed by the repeated lifting and dropping of the clothes, which is typically implemented by the rotating drum. The illustrated exemplary washing machine of FIGS. 1 and 2 is a horizontal axis washing machine.

With continued reference to FIG. 2, the motor 22 may rotate the drum 16 at various speeds in opposite rotational directions. In particular, the motor 22 may rotate the drum 16 at tumbling speeds wherein the fabric items in the drum 16 rotate with the drum 16 from a lowest location of the drum 16 towards a highest location of the drum 16, but fall back to the lowest location of the drum 16 before reaching the highest location of the drum 16. The rotation of the fabric items with the drum 16 may be facilitated by the baffles 20. Typically, the radial force applied to the fabric items at the tumbling speeds may be less than about 1 G. Alternatively, the motor 22 may rotate the drum 16 at spin speeds wherein the fabric items rotate with the drum 16 without falling. In the washing machine art, the spin speeds may also be referred to as satellizing speeds or sticking speeds. Typically, the force applied to the fabric items at the spin speeds may be greater than or about equal to 1 G. As used herein, "tumbling" of the drum 16 refers to rotating the drum at a tumble speed, "spinning" the drum 16 refers to rotating the drum 16 at a spin speed, and "rotating" of the drum 16 refers to rotating the drum 16 at any speed.

The washing machine 10 of FIG. 2 may further include a liquid supply and recirculation system. Liquid, such as water, may be supplied to the washing machine 10 from a water supply 29, such as a household water supply. A first supply conduit 30 may fluidly couple the water supply 29 to a detergent dispenser 32. An inlet valve 34 may control flow of the liquid from the water supply 29 and through the first supply conduit 30 to the detergent dispenser 32. The inlet valve 34 may be positioned in any suitable location between the water supply 29 and the detergent dispenser 32. A liquid conduit 36 may fluidly couple the detergent dispenser 32 with the tub 14. The liquid conduit 36 may couple with the tub 14 at any suitable location on the tub 14 and is shown as being coupled to a front wall of the tub 14 in FIG. 1 for exemplary purposes. The liquid that flows from the detergent dispenser 32 through the liquid conduit 36 to the tub 14 typically enters a space between the tub 14 and the drum 16 and may flow by gravity to a sump 38 formed in part by a lower portion 40 of the tub 14. The sump 38 may also be formed by a sump conduit 42 that may fluidly couple the lower portion 40 of the tub 14 to a pump 44. The pump 44 may direct fluid to a drain conduit 46, which may drain the liquid from the washing machine 10, or to a recirculation conduit 48, which may terminate at a recirculation inlet 50. The recirculation inlet 50 may direct the liquid from the recirculation conduit 48 into the drum 16. The recirculation inlet 50 may introduce the liquid into the drum 16 in any suitable manner, such as by spraying, dripping, or providing a steady flow of the liquid.

The exemplary washing machine 10 may further include a steam generation system. The steam generation system may include a steam generator 60 that may receive liquid from the water supply 29 through a second supply conduit 62, optionally via a reservoir 64. The inlet valve 34 may control flow of the liquid from the water supply 29 and through the second supply conduit 62 and the reservoir 64 to the steam generator 60. The inlet valve 34 may be positioned in any suitable location between the water supply 29 and the steam generator 60. A steam conduit 66 may fluidly couple the steam generator 60 to a steam inlet 68, which may introduce steam into the tub 14. The steam inlet 68 may couple with the tub 14 at any suitable location on the tub 14 and is shown as being coupled to a rear wall of the tub 14 in FIG. 2 for exemplary purposes. The steam that enters the tub 14 through the steam inlet 68 may subsequently enter the drum 16 through the perforations 18. Alternatively, the steam inlet 68 may be configured to introduce the steam directly into the drum 16. The steam inlet 68 may introduce the steam into the tub 14 in any suitable manner.

An optional sump heater 52 may be located in the sump 38. The sump heater 52 may be any type of heater and is illustrated as a resistive heating element for exemplary purposes. The sump heater 52 may be used alone or in combination with the steam generator 60 to add heat to the chamber 15. Typically, the sump heater 52 adds heat to the chamber 15 by heating water in the sump 38. The tub 14 may further include a temperature sensor 54, which may be located in the sump 38 or in another suitable location in the tub 14. The temperature sensor 54 may sense the temperature of water in the sump 38, if the sump 38 contains water, or a general temperature of the tub 14 or interior of the tub 14. The tub 14 may alternatively or additionally have a temperature sensor 56 located outside the sump 38 to sense a general temperature of the tub or interior of the tub 14. The temperature sensors 54, 56 may be any type of temperature sensors, which are well-known to one skilled in the art. Exemplary temperature sensors for use as the temperature sensors 54, 56 include thermistors, such as a negative temperature coefficient (NTC) thermistor.

The washing machine 10 may further include an exhaust conduit (not shown) that may direct steam that leaves the tub 14 externally of the washing machine 10. The exhaust conduit may be configured to exhaust the steam directly to the exterior of the washing machine 10. Alternatively, the exhaust conduit may be configured to direct the steam through a condenser prior to leaving the washing machine 10. Examples of exhaust systems are disclosed in the following patent applications, which are incorporated herein by reference in their entirety: U.S. patent application Ser. No. 11/464,506, titled "Fabric Treating Appliance Utilizing Steam," U.S. patent application Ser. No. 11/464,501, titled "A Steam Fabric Treatment Appliance with Exhaust," U.S. patent application Ser. No. 11/464,521, titled "Steam Fabric Treatment Appliance with Anti-Siphoning," and U.S. patent application Ser. No. 11/464,520, titled "Determining Fabric Temperature in a Fabric Treating Appliance," all filed Aug. 15, 2006.

The steam generator 60 may be any type of device that converts the liquid to steam. For example, the steam generator 60 may be a tank-type steam generator that stores a volume of liquid and heats the volume of liquid to convert the liquid to steam. Alternatively, the steam generator 60 may be an in-line steam generator that converts the liquid to steam as the liquid flows through the steam generator 60. As another alternative, the steam generator 60 may utilize the sump heater 52 or other heating device located in the sump 38 to heat liquid in the sump 38. The steam generator 60 may produce pressurized or non-pressurized steam.

Exemplary steam generators are disclosed in U.S. patent application Ser. No. 11/464,528, titled "Removal of Scale and Sludge in a Steam Generator of a Fabric Treatment Appliance," U.S. patent application Ser. No. 11/450,836, titled "Prevention of Scale and Sludge in a Steam Generator of a Fabric Treatment Appliance," and U.S. patent application Ser. No. 11/450,714, titled "Draining Liquid From a Steam Generator of a Fabric Treatment Appliance," all filed Jun. 9, 2006, in addition to U.S. patent application Ser. No. 11/464,509, titled "Water Supply Control for a Steam Generator of a Fabric Treatment Appliance," U.S. patent application Ser. No. 11/464,514, titled "Water Supply Control for a Steam Generator of a Fabric Treatment Appliance Using a Weight Sensor," and U.S. patent application Ser. No. 11/464,513, titled "Water Supply Control for a Steam Generator of a Fabric Treatment Appliance Using a Temperature Sensor," all filed Aug. 15, 2006, which are incorporated herein by reference in their entirety.

In addition to producing steam, the steam generator 60, whether an in-line steam generator, a tank-type steam generator, or any other type of steam generator, may heat water to a temperature below a steam transformation temperature, whereby the steam generator 60 produces heated water. The heated water may be delivered to the tub 14 and/or drum 16 from the steam generator 60. The heated water may be used alone or may optionally mix with cold or warm water in the tub 14 and/or drum 16. Using the steam generator 60 to produce heated water may be useful when the steam generator 60 couples only with a cold water source of the water supply 29. Optionally, the steam generator 60 may be employed to simultaneously supply steam and heated water to the tub 14 and/or drum 16.

The liquid supply and recirculation system and the steam generation system may differ from the configuration shown in FIG. 2, such as by inclusion of other valves, conduits, wash aid dispensers, and the like, to control the flow of liquid and steam through the washing machine 10 and for the introduction of more than one type of detergent/wash aid. For example, a valve may be located in the liquid conduit 36, in the recirculation conduit 48, and in the steam conduit 66. Furthermore, an additional conduit may be included to couple the water supply 29 directly to the tub 14 or the drum 16 so that the liquid provided to the tub 14 or the drum 16 does not have to pass through the detergent dispenser 32. Alternatively, the liquid may be provided to the tub 14 or the drum 16 through the steam generator 60 rather than through the detergent dispenser 32 or the additional conduit. As another example, the liquid conduit 36 may be configured to supply liquid directly into the drum 16, and the recirculation conduit 48 may be coupled to the liquid conduit 36 so that the recirculated liquid enters the tub 14 or the drum 16 at the same location where the liquid from the detergent dispenser 32 enters the tub 14 or the drum 16.

Other alternatives for the liquid supply and recirculation system are disclosed in U.S. patent application Ser. No. 11/450,636, titled "Method of Operating a Washing Machine Using Steam;" U.S. patent application Ser. No. 11/450,529, titled "Steam Washing Machine Operation Method Having Dual Speed Spin Pre-Wash;" and U.S. patent application Ser. No. 11/450,620, titled "Steam Washing Machine Operation Method Having Dry Spin Pre-Wash," all filed Jun. 9, 2006, which are incorporated herein by reference in their entirety.

Figure 3:
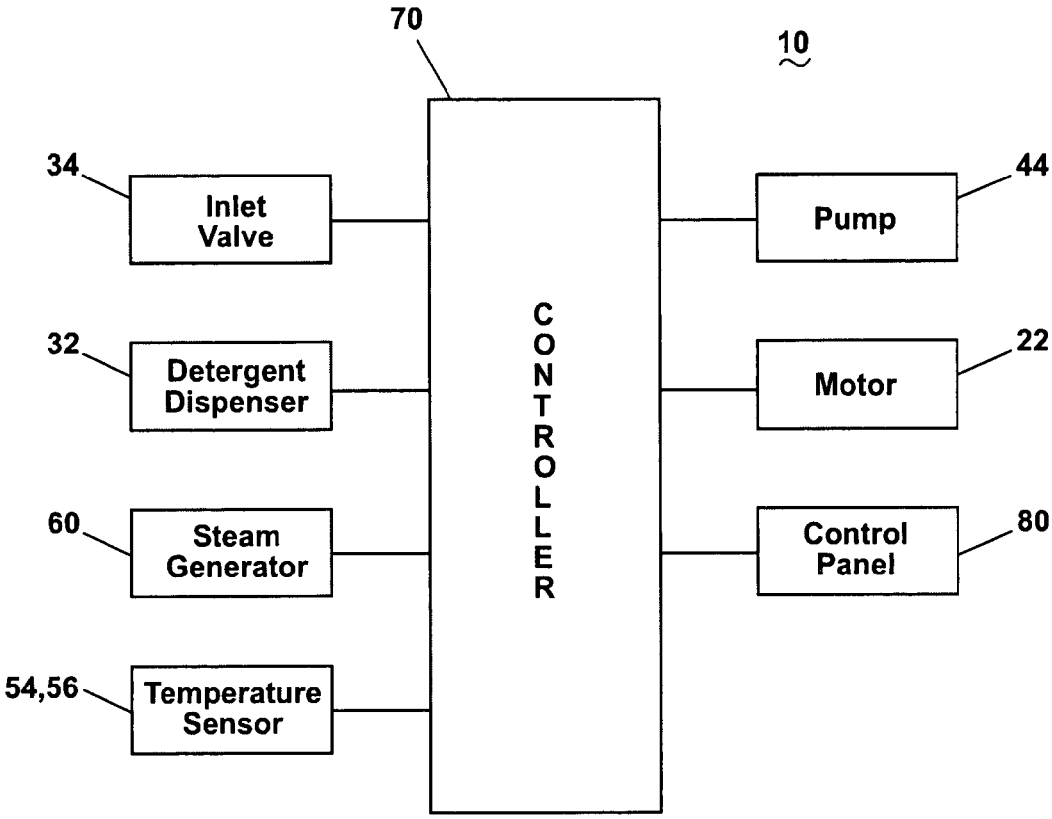
FIG. 3 is a schematic view of an exemplary control system of the fabric treatment appliance of FIG. 1.

Referring now to FIG. 3, which is a schematic view of an exemplary control system of the washing machine 10, the washing machine 10 may further include a controller 70 coupled to various working components of the washing machine 10, such as the pump 44, the motor 22, the inlet valve 34, the detergent dispenser 32, and the steam generator 60, to control the operation of the washing machine 10. If the optional sump heater 52 is used, the controller may also control the operation of the sump heater 52. The controller 70 may receive data from one or more of the working components or sensors, such as the temperature sensors 54, 56, and may provide commands, which can be based on the received data, to one or more of the working components to execute a desired operation of the washing machine 10. The commands may be data and/or an electrical signal without data. A control panel 80 may be coupled to the controller 70 and may provide for input/output to/from the controller 70. In other words, the control panel 80 may perform a user interface function through which a user may enter input related to the operation of the washing machine 10, such as selection and/or modification of an operation cycle of the washing machine 10, and receive output related to the operation of the washing machine 10.

Many known types of controllers may be used for the controller 70. The specific type of controller is not germane to the invention. It is contemplated that the controller is a microprocessor-based controller that implements control software and sends/receives one or more electrical signals to/from each of the various components (inlet valve 34, detergent dispenser 32, steam generator 60, pump 44, motor 22, control panel 80, and temperature sensors 54, 56) to effect the control software. As an example, proportional control (P), proportional integral control (PI), and proportional derivative control (PD), or a combination thereof, a proportional integral derivative control (PID control), may be used to control the various components.

Figure 4:
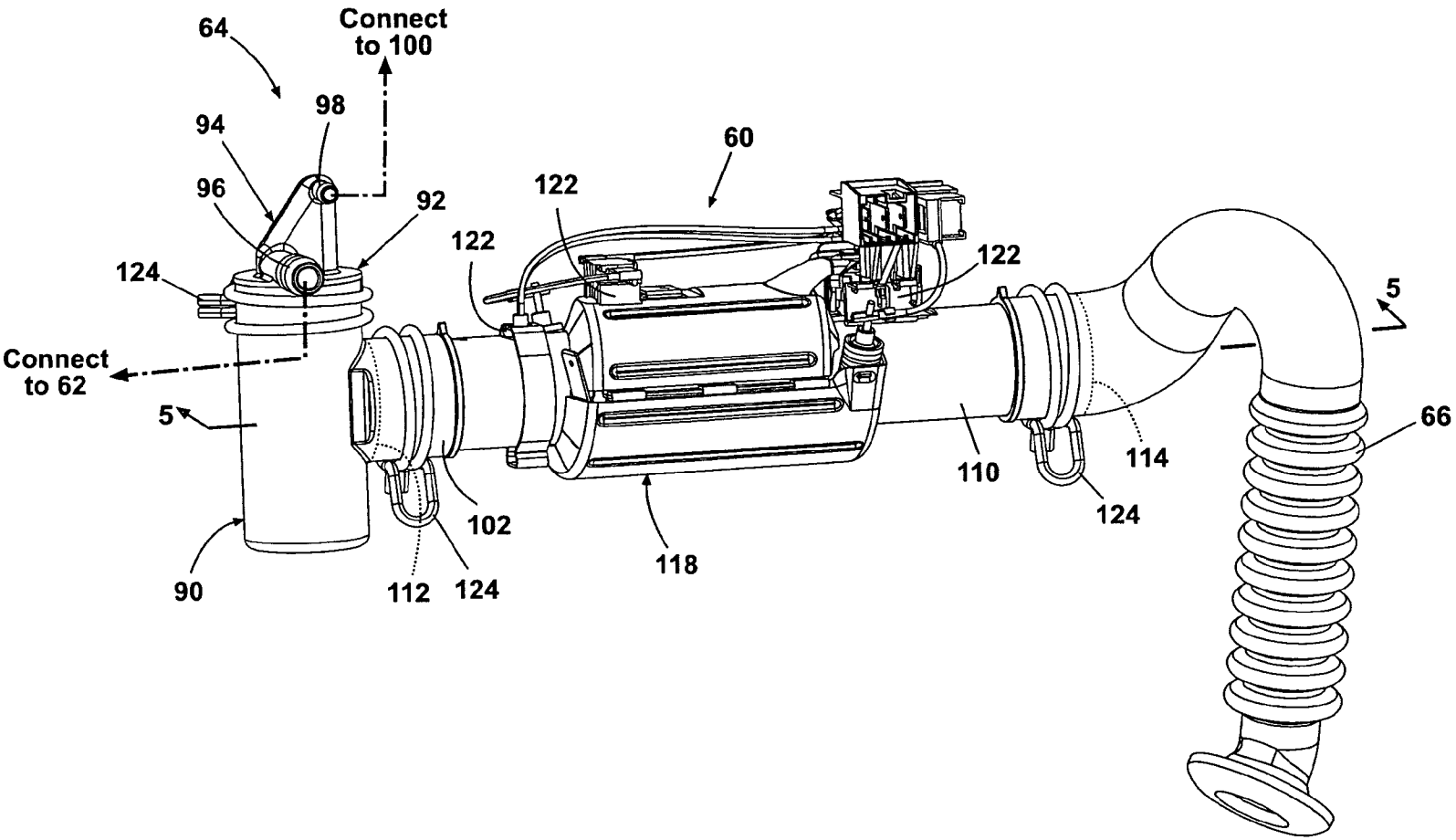
FIG. 4 is a perspective view of a steam generator from the fabric treatment appliance of FIG. 1.
Figure 5:
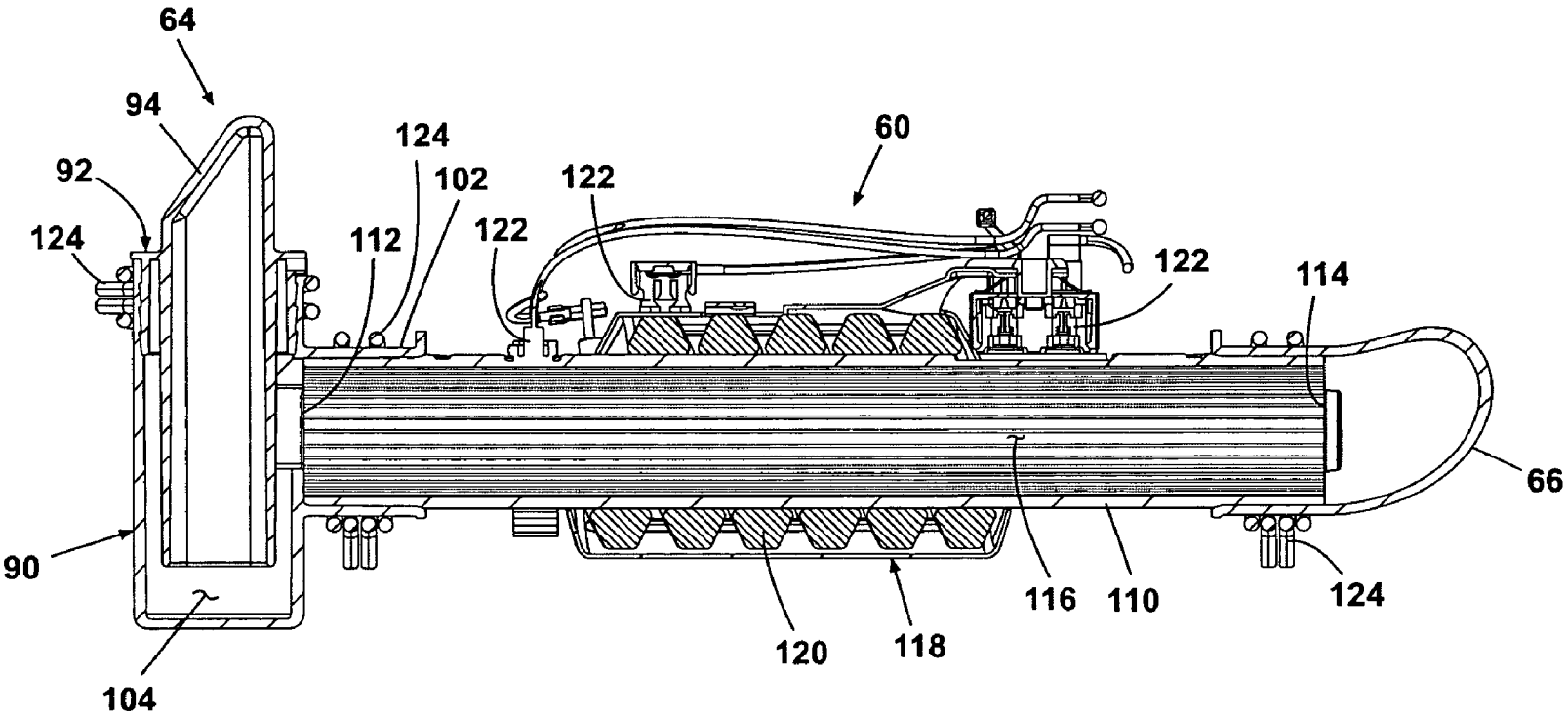
FIG. 5 is a sectional view taken along line 5-5 of FIG. 4.

FIG. 4 provides a perspective view of the reservoir 64, the steam generator 60, and the steam conduit 66. In general, the reservoir 64 may be configured to receive water from the water supply 29, store a volume of water, and supply water to the steam generator 60. In the exemplary embodiment, the reservoir 64 may include an open-top tank 90 and a lid 92 removably closing the open top of the tank 90. The reservoir 64 may include a water supply conduit 94 for supplying water from the water supply 29 to the tank 90. In the illustrated embodiment, the water supply conduit 94 may extend through the lid 92 and include a water supply inlet connector 96 and a siphon break connector 98. The water supply inlet connector 96 may be coupled to the second water supply conduit 62 (FIG. 2) to receive water from the water supply 29 and provide the water to the water supply conduit 94. The siphon break connector 98 may be coupled to a siphon break conduit 100 (FIG. 2) to form a siphon break device. The siphon break conduit 100 may be coupled to atmosphere external to the washing machine 10. The water supply inlet connector 96, the siphon break connector 98, and the water supply conduit 94 may be in fluid communication with one another. The reservoir 64 may further include a steam generator connector 102 for coupling the tank 90 to the steam generator 60 and supplying water from the tank 90 to the steam generator 60. In the illustrated embodiment, the steam generator connector 102 may project laterally from the tank 90. As seen in FIG. 5, which is a sectional view of the reservoir 64, the steam generator 60, and the steam conduit 66, the steam generator connector 102 fluidly communicates the steam generator 60 with an interior or chamber 104 of the tank 90.

With continued reference to FIG. 5, while the steam generator 60 can be any type of steam generator, the exemplary steam generator 60 of the current embodiment is in the form of an in-line steam generator with a tube 110 having a first end 112 coupled to the steam generator connector 102 of the reservoir 64 and a second end 114 coupled to the steam conduit 66. The tube 110 may define a steam generation chamber 116 between the first end 112 and the second end 114, which may defined an inlet and an outlet, respectively, of the steam generator 60. A heat source 118 may be positioned relative to the tube 110 and the steam generation chamber 116 to provide heat to the tube 110 and the steam generation chamber 116. In the current embodiment, the heat source 118 includes a resistive heater 120 coiled around the tube 110 in a generally central location relative to the first and second ends 112, 114. The steam generator 60 may have temperature sensors 122 associated with the tube 110 and/or the heat source 118 and in communication with the controller 70 for operation of the heat source 118 and/or supply of water to the steam generator 60. Clamps 124 may be employed to secure the steam generator tube 110 to the steam generator connector 102 of the reservoir 64 and to the steam conduit 66 and to secure the reservoir lid 92 to the tank 90.

The steam generator 60 may be employed for steam generation during operation of the washing machine 10, such as during a wash operation cycle, which can include prewash, wash, rinse, and spin steps, during a washing machine cleaning operation cycle to remove or reduce biofilm and other undesirable substances, like microbial bacteria and fungi, from the washing machine, during a refresh or dewrinkle operation cycle, or during any other type of operation cycle. The steam generator may also be employed for generating heated water during operation of the washing machine 10. The steam generator 60 may also be employed to clean itself, and an example of a method for cleaning the steam generator 60 is disclosed in the U.S. Patent Application titled "Method for Cleaning a Steam Generator,", which is incorporated herein by reference in its entirety.

As described in the background of the invention, calcification of the steam generator 60 can detrimentally affect heat transfer and the efficiency of steam generation by the steam generator 60. However, the operation of the steam generator 60 may be controlled in a manner to optimize or at least improve the efficiency of steam generation by the steam generator 60 in response to calcification of the steam generator 60. A method according to one embodiment of the invention for operating the steam generator 60 incorporates setting an operational temperature range for the steam generator 60 and changing a flow rate of water to the steam generator 60 based on calcification of the steam generator 60 to improve the efficiency of the steam generator 60. The combination of the operational temperature range and the flow rate of the water determine calcification of the steam generator 60, particularly by determining a change in the calcification of the steam generator 60. The manner of determining the change in the calcification of the steam generator 60 will be more readily understood in light of the following description and examples.

The operational temperature range for the steam generator 60 may include an operational temperature maximum and an operational temperature minimum, and an actual temperature of the steam generator 60, which may be determined by the temperature sensors 122 or other temperature detection devices, more or less lies between the operational temperature maximum and minimum. The operational temperature range may be selected to correspond to a desired steam output and steam generation efficiency and may shift during operation of the steam generator 60 in response to a change in the calcification of the steam generator 60. During operation of the steam generator 60, the controller 70 may control the steam generator 60 and the water supply to the steam generator 60 to maintain the actual temperature within the operational temperature range. In reality, maintaining the actual temperature within the operational temperature range may be difficult due to operational factors (i.e., the actual temperature may transiently exceed or fall below the operational temperature maximum and operational temperature minimum, respectively), but, for the most part, the controller 70 maintains the actual temperature within the operational temperature range. When conditions prevent the controller 70 from maintaining the actual temperature within the operational temperature range (i.e., the actual temperature crossing the operational temperature—exceeding the operation temperature maximum or falling below the operational temperature minimum—without the controller 70 being able to return the actual temperature to within the actual temperature range), as will be described below, the operational temperature range may shift up or down, depending on the conditions preventing the maintaining of the actual temperature in the operational temperature range.

Figure 6:
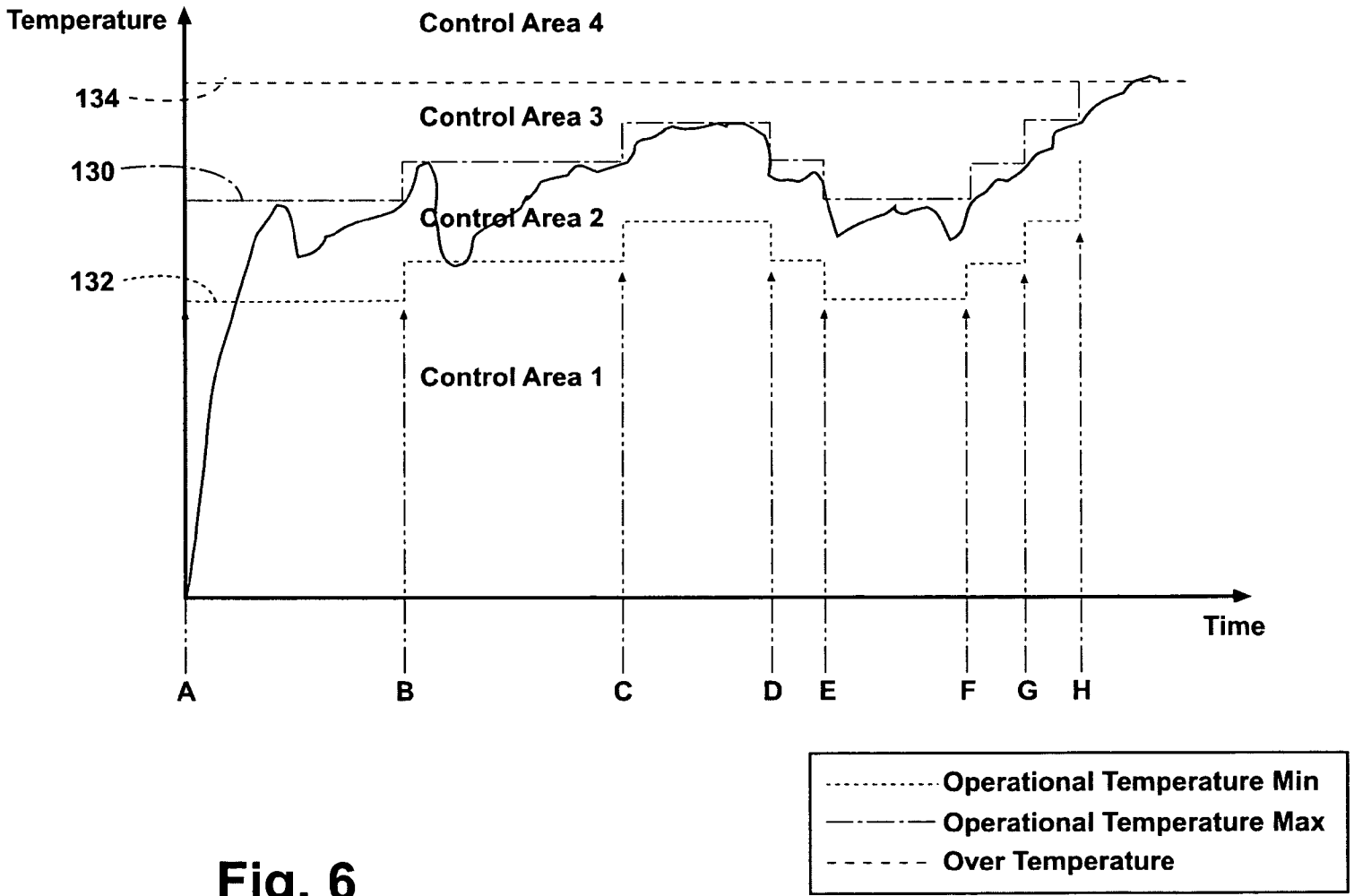
FIG. 6 is a graph of temperature as a function of time corresponding to a method according to one embodiment of the invention for operating the steam generator from the washing machine of FIG. 1.

Referring now to FIG. 6, which is an exemplary graph of the actual temperature as a function of time corresponding to a method according to one embodiment of the invention for operating the steam generator 60, the actual temperature lies within the operational temperature maximum, indicated by a line 130, and the operational temperature minimum, indicated by a line 132. The operational temperature maximum and minimum in the graph exhibit several shifts up and down in accordance with the inventive method to achieve a desired steam generation efficiency. The graph illustrates various control areas for the control of the steam generator 60; when the actual temperature enters the respective control areas, the controller 70 acts in a predetermined manner in accordance with the control area entered. For example, for a control area 1, which is an area below the operational temperature minimum, the actual temperature would be too low, and the controller 70 would decrease a flow rate of water to the steam generator 60 to attempt to increase the actual temperature.

In a control area 2, which is an area between the operational temperature minimum and the operational temperature maximum, the actual temperature would be acceptable, and the controller 70 would decrease the flow rate of water to the steam generator 60 in small steps. Decreasing the flow rate of water in small steps gradually decreases the flow rate of water in an effort to utilize the least amount of water needed for steam generation. Using an amount of water greater than an amount necessary for a desired steam output may result in outputting small amounts of water with steam or outputting greater amounts of water without appreciable steam output. Under most operating conditions, outputting additional water from the steam generator 60 is not desired as it is not resource efficient from both a water usage perspective and an electricity consumption perspective—a greater volume of water in the steam generator 60 means more heat is required to boil the water to produce steam. Gradually reducing the flow rate of water may avoid or reduce water output, minimize water usage, and improve the steam generating efficiency. Naturally, the reduction in the flow rate of water may also lead to a rise in the actual temperature to a control area 3 as there is less water to absorb the heat.

For the control area 3, which is an area above the operational temperature maximum and below an over temperature, indicated by a line 134, the actual temperature would be too high, and the controller 70 would increase the flow rate of water to the steam generator 60 to attempt to decrease the actual temperature. If the actual temperature would continue to increase to a control area 4, which is an area above the over temperature, the controller 70 would shut off the steam generator 60 to protect the steam generator 60 from potential overheating. The control area 4 represents overheating of the steam generator 60 and is static during the operation of the steam generator 60. That is, the control areas 1-3 are dependent on the operational temperature range, which may shift during the operation of the steam generator 60. The control area 4 depends only on a predetermined temperature indicative of overheating, and the predetermined temperature remains constant during the operation of the steam generator 60. It is possible to employ a dynamic predetermined temperature indicative of overheating, but the current embodiment utilizes a static predetermined temperature indicative of overheating.

Depending on the control area, the flow rate of water to the steam generator 60 may decrease (i.e., control area 1 and control area 2) or increase (i.e., control area 3). The changing of the flow rate of water to the steam generator 60 may be accomplished in any suitable manner. In the illustrated embodiment, the flow rate of water may be changed by altering the operation of the inlet valve 34 (FIG. 2). For example, the inlet valve 34 may operate according to a duty cycle wherein the inlet valve 34 may be opened for a predetermined amount of opened time and closed for a predetermined amount of closed time. The opened time and closed time may be equal or may be unequal, depending on a desired flow rate to the steam generator 60. Further, the duty cycle may be altered by increasing and/or decreasing one or more of the opened and closed times by the same or differing amounts of time. The flow rate of water may be changed within a range of flow rates, which may depend on the opened and closed times of the inlet valve 34. For example, the inlet valve 34 may have a maximum opened time and a minimum opened time to define an opened time range and a maximum closed time and a minimum closed time to define a closed time range. Changing the opened time and the closed time within their respective ranges correspondingly changes the flow rate of water to the steam generator 60. For example, increasing the opened time while either decreasing or maintaining the closed time results in increasing the flow rate of water, and increasing the closed time while either decreasing or maintaining the opened time results in a decreasing the flow rate of water. A maximum flow rate of water may be achieved with the opened time at the maximum opened time and the closed timed at the minimum closed time, and a minimum flow rate of water (non-zero flow rate) may be achieved with the opened time at the minimum opened time and the closed time at the maximum closed time. The actual flow rates of water resulting from the opened and closed times depends on several factors, including the geometry of the steam generator 60 and the flow rate of the inlet valve 34.

In the context of a fixed volume steam generator, the maximum opened time and the minimum closed time can be selected to prevent overfilling the steam generator 60 as overfilling would lead to extra water flowing out the steam conduit 66, or run dry, which would lead to a stoppage in the generation of steam.

A change in the calcification of the steam generator 60, such as by increasing or decreasing the amount of deposits in the steam generator 60, affects heat transfer in the steam generator 60. An increase in the calcification tends to hinder heat transfer from the heat source 118 to water in the steam generator 60. The deposits add mass through which the heat must flow to reach the water. Further, the deposits are poor conductors of heat and provide an insulating effect to the steam generator 60. Thus, the increasing calcification causes an increase in the actual temperature of the steam generator 60 as the heat produced by the heat source 118 heats the steam generator 60 itself and the deposits. As calcification increases, the actual temperature of the steam generator must be increased to higher temperature for the water on the interior to reach a temperature sufficient for conversion of the water to steam. Conversely, a decrease in the calcification, which may occur naturally during operation of the steam generator 60 due to cracking of the deposits, i.e., the separating of at least a portion of the deposits from each other or from the steam generator tube 110, or may occur as a result of a steam generator cleaning process, such as the process described in the aforementioned and incorporated patent application titled "Method for Cleaning a Steam Generator," leads to a decrease in the actual temperature of the steam generator 60 as the excess heat that previously heated the steam generator 60 itself and the deposits may be transferred to the water in the steam generator 60 for steam conversion. Thus, as calcification increases, the actual temperature in control area 2 may approach or exceed the operational temperature maximum, and, as calcification decreases, the actual temperature may reduce to or below the operational temperature minimum. This phenomenon provides the basis for correlating the actual temperature of the steam generator and the degree of calcification. The operational temperature range may be set and adjusted during the operation of the steam generator 10 based on the calcification by monitoring the actual temperature of the steam generator 60.

When the actual temperature in control area 2 approaches or reaches the operational temperature maximum, the flow rate of water to the steam generator 60, which, as described above, has been gradually decreasing, may be changed to attempt to maintain the actual temperature in the operational temperature range. For example, when the actual temperature approaches or reaches the operational temperature maximum, the flow rate of water to the steam generator 60 may be increased to attempt to maintain the actual temperature below the operational temperature maximum. The flow rate of water may be increased directly or gradually to any suitable increased flow rate of water, such as the maximum flow rate of water. If the actual temperature exceeds the operational temperature maximum and cannot be returned to below the operational temperature maximum despite the increased flow rate of water, detection of increased calcification occurs, and the operational temperature maximum may be shifted upward or increased to account for the increased calcification. Optionally, the operational temperature minimum may also be shifted upward or increased such that the operational temperature range shifts upward as a unit. Exemplary upward operational temperature range shifts may be observed at points B, C, F, G, and H in FIG. 6.

Conversely, when the actual temperature in control area 2 reaches the operational temperature minimum, and the flow rate of water to the steam generator 60, which, as described above, has been gradually decreasing, has reached the minimum flow rate of water, detection of decreased calcification occurs, and the operational temperature minimum may be shifted downward or decreased to account for the decreased calcification. Optionally, the operational temperature maximum may also be shifted downward or decreased such that the operational temperature range shifts downward as a unit. Exemplary upward operational temperature range shifts may be observed at points D and E in FIG. 6.

The remainder of the description will assume coincident shifting of the operational temperature maximum and minimum, with it being understood that one may shift independently of the other and that the amount of shifting (i. e., number of degrees shifted) may be different for the operational temperature maximum and operational temperature minimum.

The shift in the operational temperature range may be any suitable shift. For example, the operational temperature range may shift by one degree Celsius. Further, the upward shifts and the downward shifts may be by the same number of degrees Celsius or a different number of degrees Celsius. Shifting of the operational temperature range may be within a range of temperatures. For example, the operational temperature maximum may be shifted between 98° C. and 147° C., and the operational temperature minimum may be shifted between 96° C. and 145° C., with the operational temperature range being about 2° C. In this example, the over temperature may be about 150° C. These temperatures are provided for illustrative purposes only, and it is within the scope of the invention to utilize any suitable operational temperatures and any suitable operational temperature range. It is contemplated that the amount of shift may be governed by factors such as: physical characteristics of the specific steam generator; precision and accuracy of the control system, including the temperature sensors; and operating environment. Any of these factors are subject to compromise between the technically possible and what is practical.

FIGS. 7A and 7B and 8A-8H are exemplary graphs of the actual temperature as a function of time for a single operational cycle of the above-described method of operating the steam generator 60 under conditions of no detected calcification (FIGS. 7A and 7B) and detected increased calcification and decreased calcification (FIGS. 8A-8H). The graphs in FIGS. 7A-8H display theoretical behavior of the actual temperature and have not been generated with actual test data.

Figure 7A:
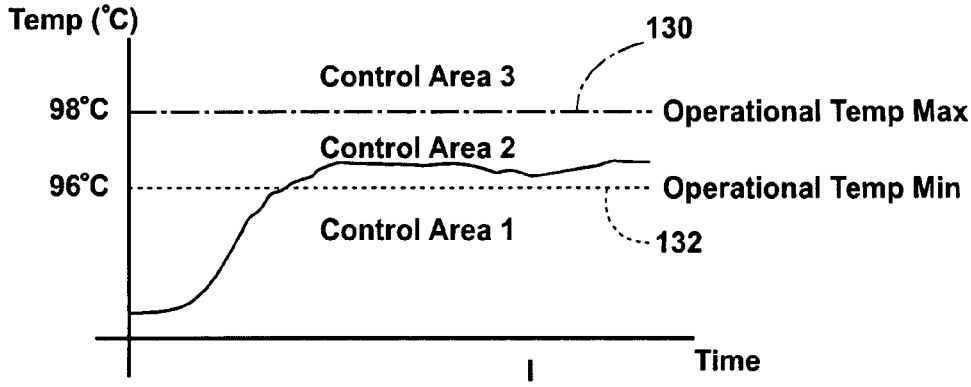
FIGS. 7A and 7B are exemplary graphs of temperature as a function of time for an initial phase (FIG. 7A) and a steam generation phase (FIG. 7B) of the method of FIG. 6 for operating the steam generator wherein the steam generator does not exhibit significant calcification.
Figure 7B:
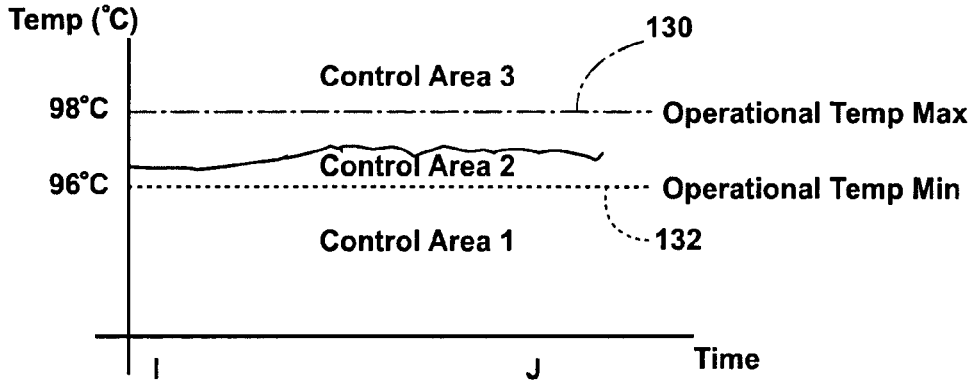

FIG. 7A illustrates an initial phase of steam generator operation where the actual temperature increases from ambient temperature to within the operational temperature range. The flow rate of water during the initial phase can be any suitable flow rate, such as an intermediate flow rate between the maximum and minimum flow rates. When the actual temperature levels off in the operational temperature range for a steam generation phase, which begins in FIG. 7A and continues in FIG. 7B, the flow rate of water gradually decreases, as described above for control area 2. As the flow rate of water gradually decreases, the actual temperature may remain relatively constant due to good heat transfer in the absence of calcification. Potentially, the actual temperature may increase due to the gradual decrease in the flow rate of water, and, in response, the flow rate of water may increase to reduce the actual temperature and maintain the actual temperature in the operational temperature range. When the actual temperature decreases or is otherwise maintained within the operational temperature range, the flow rate of water may begin to gradually decrease again. Because no increase in calcification occurs, the actual temperature may be controlled within the control area 2 via changing the flow rate of water.

Figure 8A:
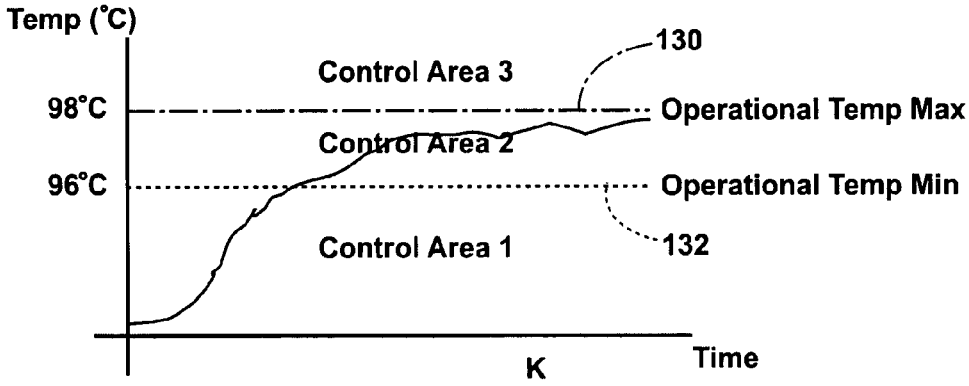
FIGS. 8A-8H are exemplary graphs of temperature as a function of time for an initial phase (FIG. 8A) and a steam generation phase (FIGS. 8B-8H) of the method of FIG. 6 for operating the steam generator wherein the steam generator exhibits increased calcification and decreased calcification.
Figure 8B:
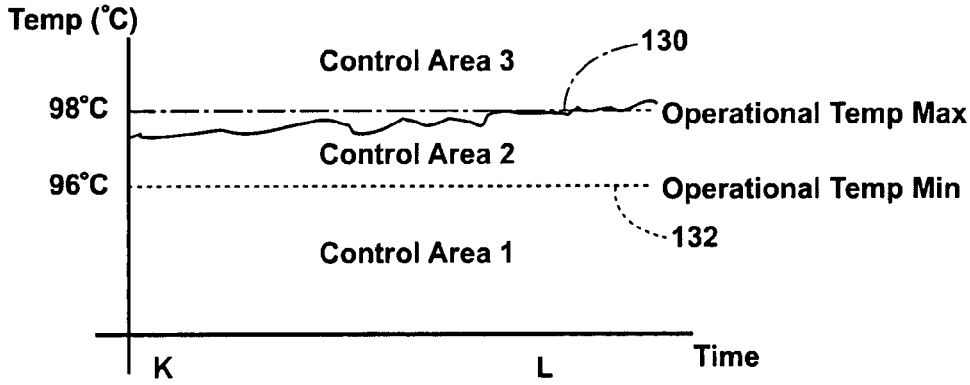
Figure 8C:
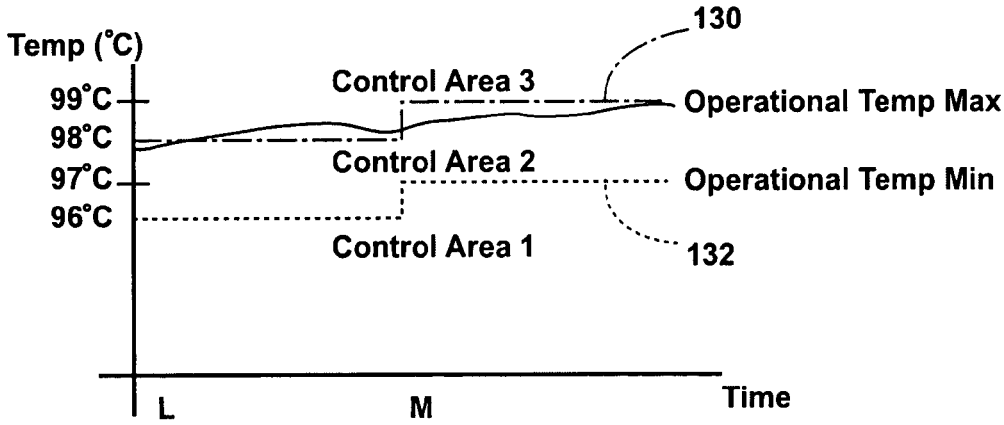

Referring now to FIGS. 8A-8H, FIG. 8A illustrates the initial phase of steam generator operation similar to that shown in FIG. 7A. After the actual temperature reaches the operational temperature range to begin the steam generation phase, the flow rate of water gradually decreases, as described above for control area 2. However, the actual temperature reaches the operational temperature maximum around time L, as shown in FIG. 8B. At this time, the flow rate of water may be increased to attempt to reduce the actual temperature to within the operational temperature range. For example, the flow rate of water may be increased to the maximum flow rate of water, either directly or gradually, to attempt to reduce the actual temperature. If the actual temperature exceeds and remains above the operational temperature maximum despite the increased flow rate of water, thereby indicating increased calcification, the operational temperature range may be shifted upward, as shown in FIG. 8C around time M. In the example, the operational temperature range shifts upward by 1° C., such that the operational temperature maximum and minimum shift from 98° C. to 99° C. and 96° C. to 97° C., respectively. The upward shift in the operational temperature range accounts for the increased calcification and improves the steam generation efficiency of the steam generator 60.

Figure 8D:
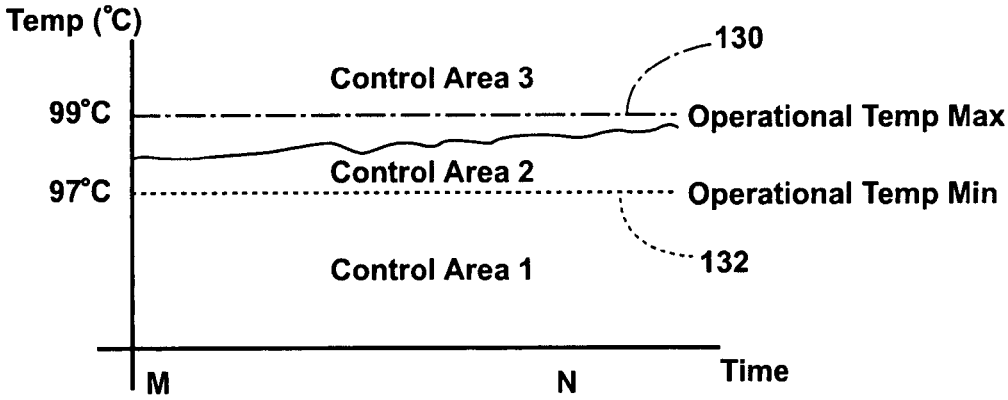
Figure 8E:
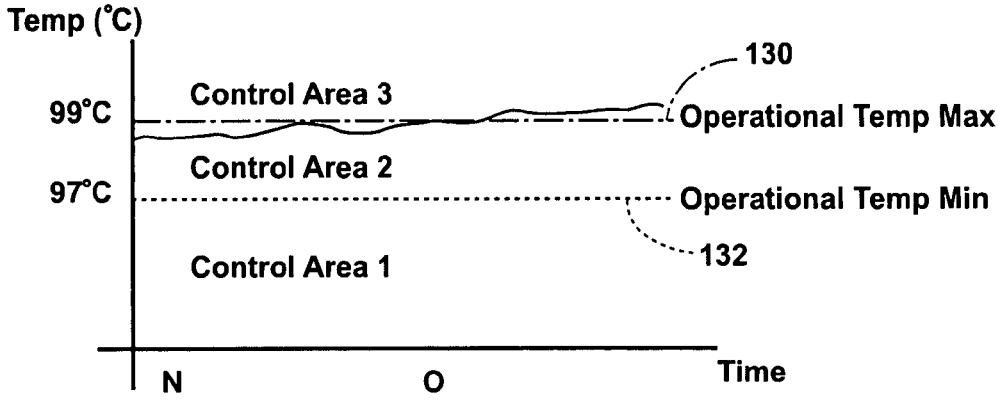
Figure 8F:
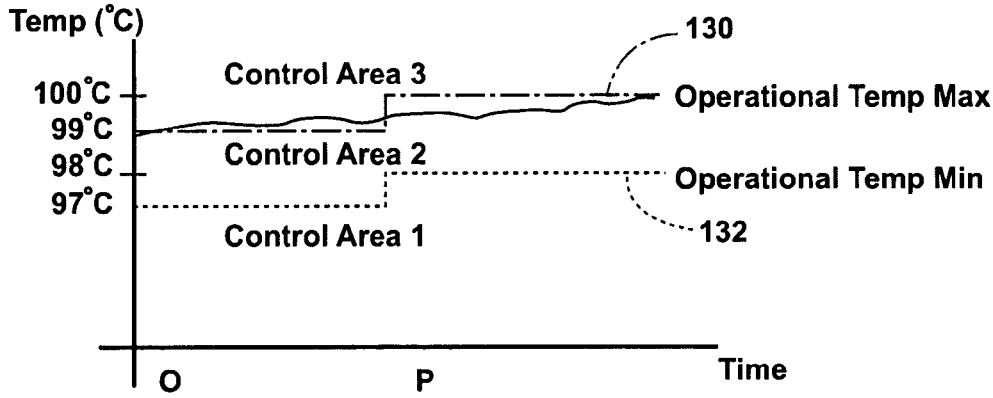

After the operational temperature range shift, which corresponds to shifting the control area 2, the actual temperature becomes stable in the control area 2, as shown in FIG. 8D, and the flow rate of water gradually decreases as described above. Moving to FIG. 8E, at about time O, the actual temperature reaches the operational temperature maximum again, and the flow rate of water may be increased to attempt to reduce the actual temperature to within the operational temperature range. For example, the flow rate of water may be increased to the maximum flow rate of water, either directly or gradually, to attempt to reduce the actual temperature. If the actual temperature exceeds and remains above the operational temperature maximum despite the increased flow rate of water, thereby indicating increased calcification, the operational temperature range may be shifted upward, as shown in FIG. 8F around time P. In the example, the operational temperature range shifts upward by 1° C., such that the operational temperature maximum and minimum shift from 99° C. to 100° C. and 97° C. to 98° C., respectively.

Figure 8G:
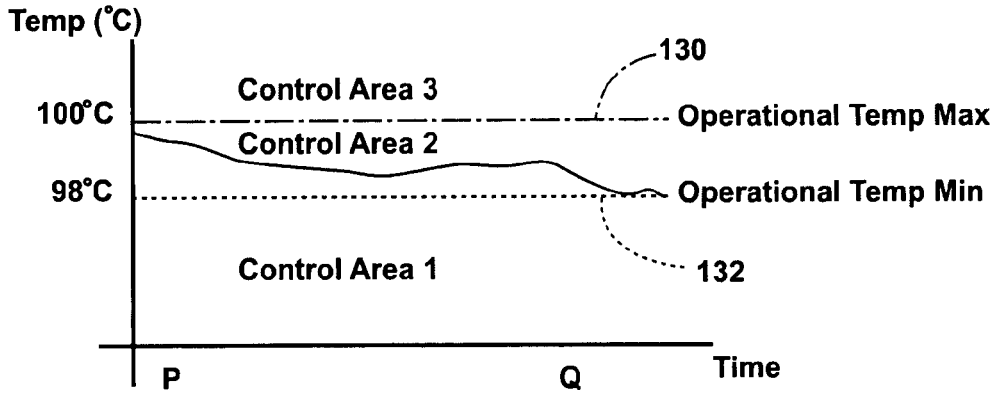
Figure 8H:
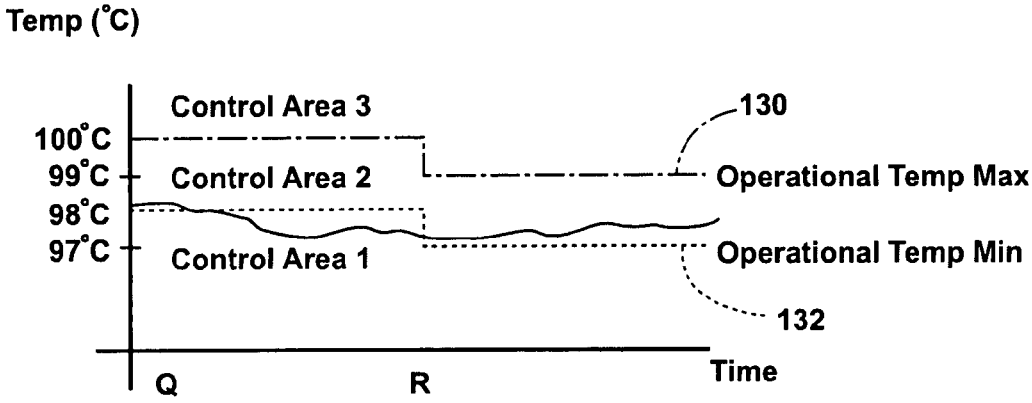

After the second operational temperature range shift, the actual temperature becomes stable in the control area 2, as shown in FIG. 8G, and the flow rate of water gradually decreases as described above. While the flow rate of water gradually decreases, the actual temperature also decreases due to decreasing calcification. As shown in FIG. 8H, at about time Q, the actual temperature reaches the operational temperature minimum. At about time R, the flow rate of water decreases to the minimum flow rate of water. Because the actual temperature continues to decrease into control area 1 at the minimum flow rate of water, thereby indicating decreasing calcification, the operational temperature range may be shifted downward. In the example, the operational temperature range shifts downward by 1° C., such that the operational temperature maximum and minimum shift from 100° C. to 99° C. and 98° C. to 97° C., respectively. The downward shift in the operational temperature range accounts for the decreased calcification and improves the steam generation efficiency of the steam generator 60.

The example provided in FIGS. 8A-8H illustrates basic behavior of the steam generator 60 for the current embodiment of the method of operating the steam generator 60. In general, the controller 70 brings the actual temperature of the steam generator 60 into the operational temperature range and gradually decreases the flow rate of water. The behavior of the actual temperature in response to the gradual decrease in the flow rate of water depends on whether a change in calcification occurs. Three situations are possible: (1) no change in calcification, (2) increase in calcification, and (3) decrease in calcification. With no change in calcification (situation 1), the actual temperature may remain stable in the operational temperature range. If the actual temperature rises within the operational temperature range without a corresponding increase in calcification, increasing the flow rate of water returns the actual temperature to the operational temperature range and/or maintains the actual temperature within the operational temperature range. With an increase in calcification (situation 2), the actual temperature may increase to the operational temperature maximum, and, in response, the flow rate of water may be increased to attempt to reduce the actual temperature. If the increase in the flow rate of water does not bring the actual temperature back into the operational temperature range, thereby indicating increased calcification, the operational temperature range may shift upward in response to the increased calcification. With a decrease in calcification (situation 3), the actual temperature may decrease to the operational temperature minimum while the flow rate of water gradually decreases. If the flow rate of water reaches the minimum flow rate, and the actual temperature remains below the operational temperature minimum, thereby indicating decreased calcification, the operational temperature range may shift downward in response to the decreased calcification. This manner of controlling the steam generator 60 in response to the calcification behavior improves the steam generation efficiency (i.e., energy or heat input compared to steam output) of the steam generator 60. Improving the steam generation efficiency may lead to producing a desired amount of steam at a desired rate while reducing water use and/or electrical use.

Figure 9A:
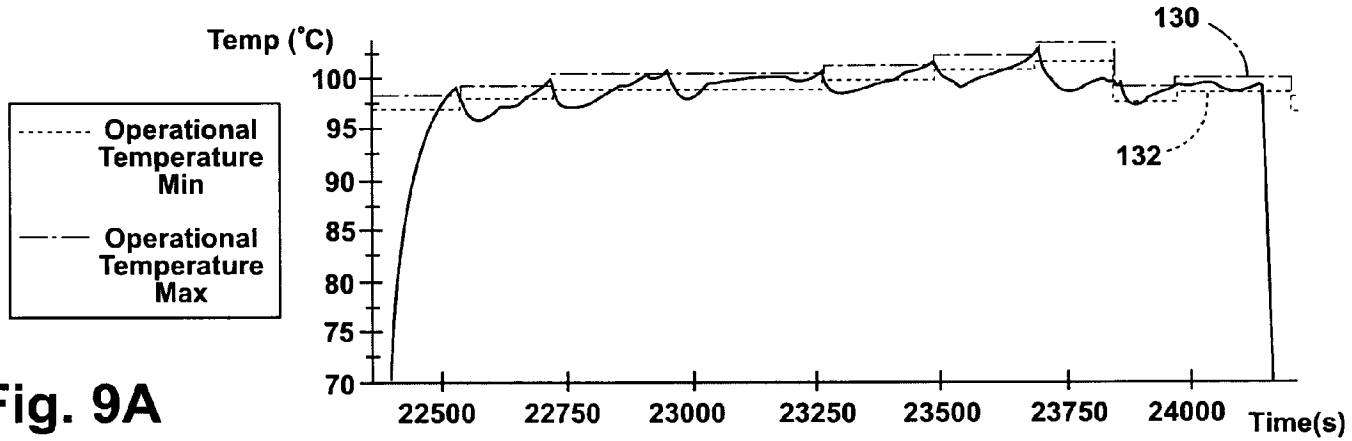
FIGS. 9A-9C are exemplary graphs of steam generator temperature, valve opened time, and valve closed time, respectively, as a function of time for an operational cycle of the steam generator operating according to the method of FIG. 6.
Figure 9B:
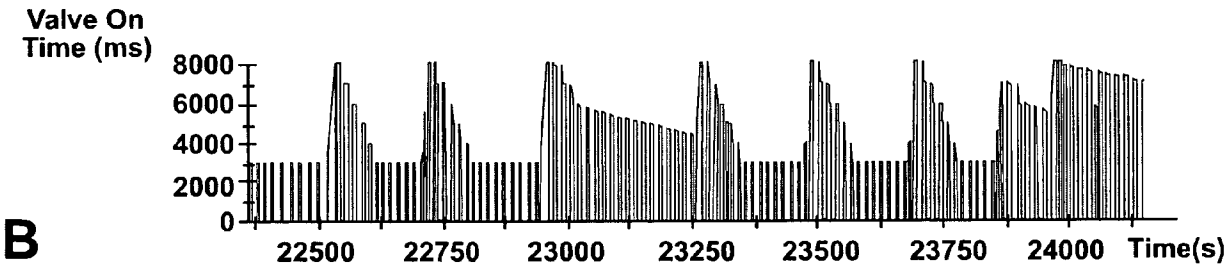
Figure 9C:
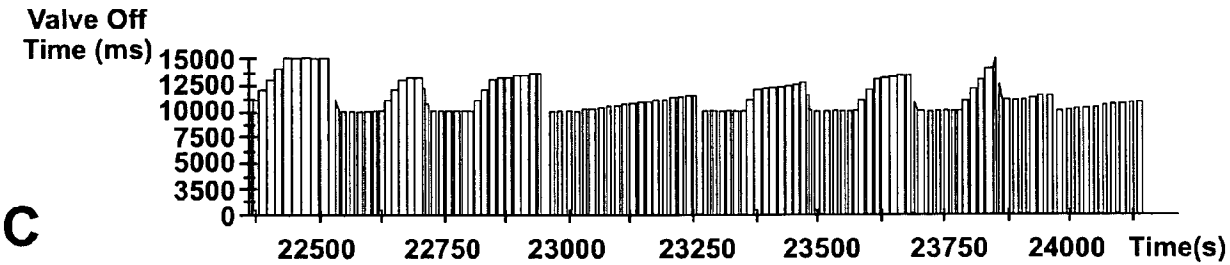
Figures 10A, 10B, 10C:
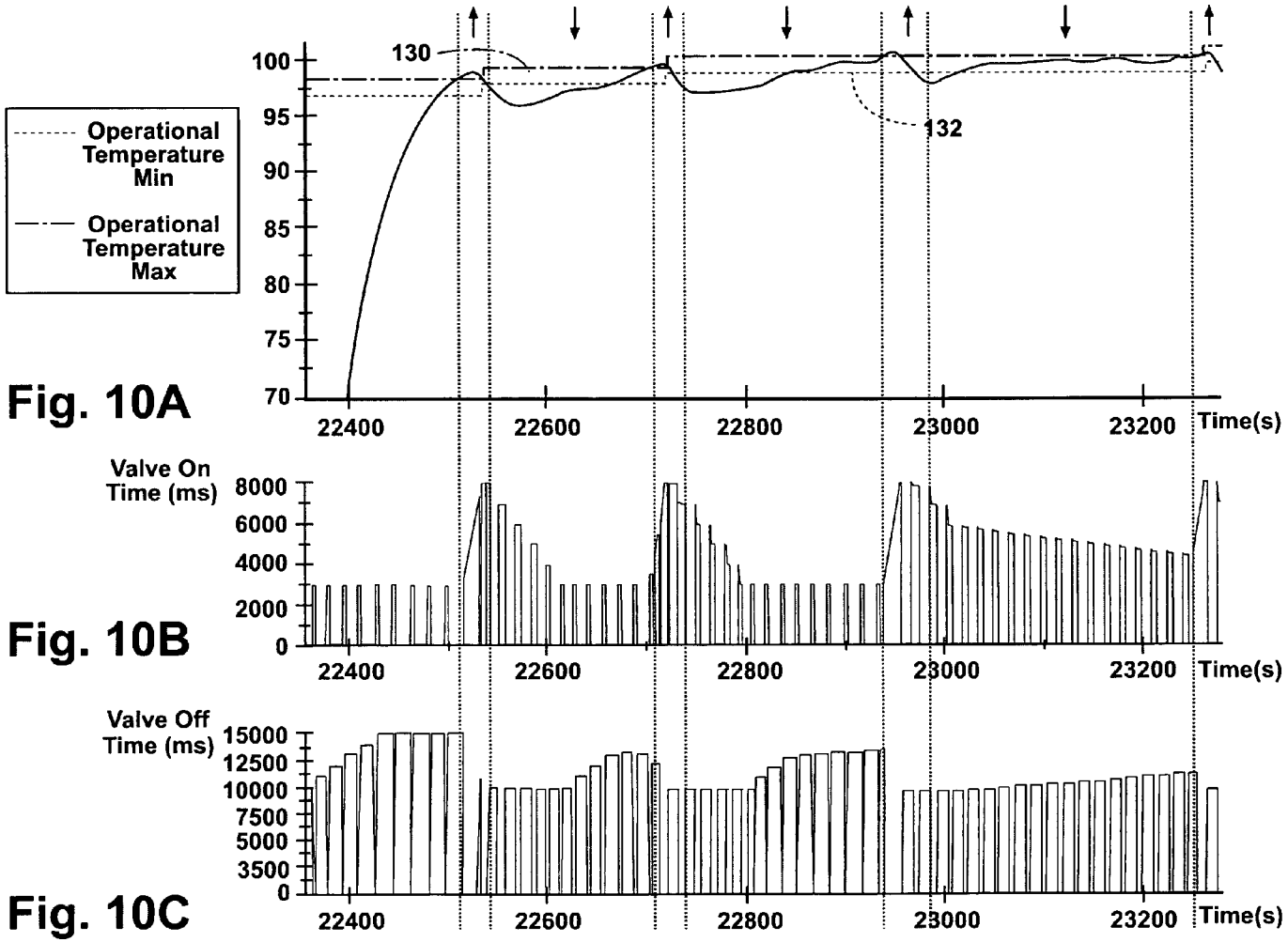
FIGS. 10A-10C are magnified views of the exemplary graphs of FIGS. 9A-9C showing a portion of the operational cycle, particularly the beginning portion of the operational cycle.

FIGS. 9A-9C are exemplary graphs of the actual temperature, valve opened time, and valve closed time, respectively, as a function of time for an operational cycle of the steam generator 60 operating according to the method described above. FIGS. 10A-10C are magnified views of the exemplary graphs of FIGS. 9A-9C showing a portion of the operational cycle, particularly the beginning portion of the operational cycle. As seen in FIGS. 10A-10C, after the operational cycle reaches the steam generation phase following the initial phase, the valve opened (i.e., on) and closed (i.e., off) times may be controlled to increase the flow rate of water, as indicated by regions having arrows pointing upward, when the actual temperature reaches the operational temperature maximum. In the particular embodiment, the valve opened time increases to the maximum opened time, about 8000 ms, with the valve closed time reduced to the minimum valve closed time, about 10,000 ms, to increase the flow rate of water. Detection of increased calcification after the increase in the flow rate of water results in shifting the operational temperature range upward, as shown after the first, second, and fourth instances of increasing the flow rate of water. No detection of increased calcification after the increase in the flow rate of water results in no shift of the operational temperature range, as shown after the third instance of increasing the flow rate of water. After the shift in the operational temperature range or the return of the actual temperature to the control area 2, the valve opened and closed times may be controlled to gradually decrease the flow rate of water, as indicated by regions having arrows pointing downward. In the particular embodiment, the valve opened time first decreases to the minimum opened time, about 3000 ms while the valve closed time remains at the minimum valve closed time, about 10,000 ms, followed by the valve opened time being maintained at the minimum opened time while the valve closed time increases from the minimum valve closed time to the maximum valve closed time, about 15,000 ms, to decrease the flow rate of water.

Figure 11:
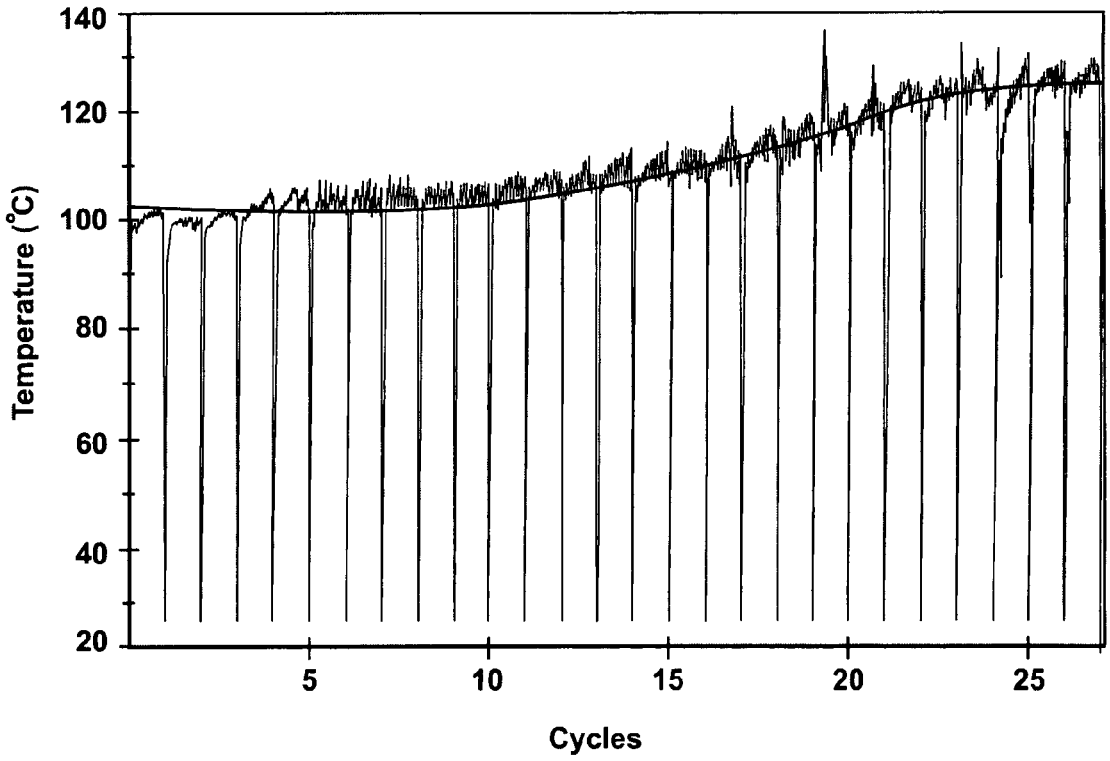
FIG. 11 is an exemplary graph of steam generator temperature as a function of time for twenty-seven operational cycles of the steam generator operating according to the method of FIG. 6.
Figure 12:
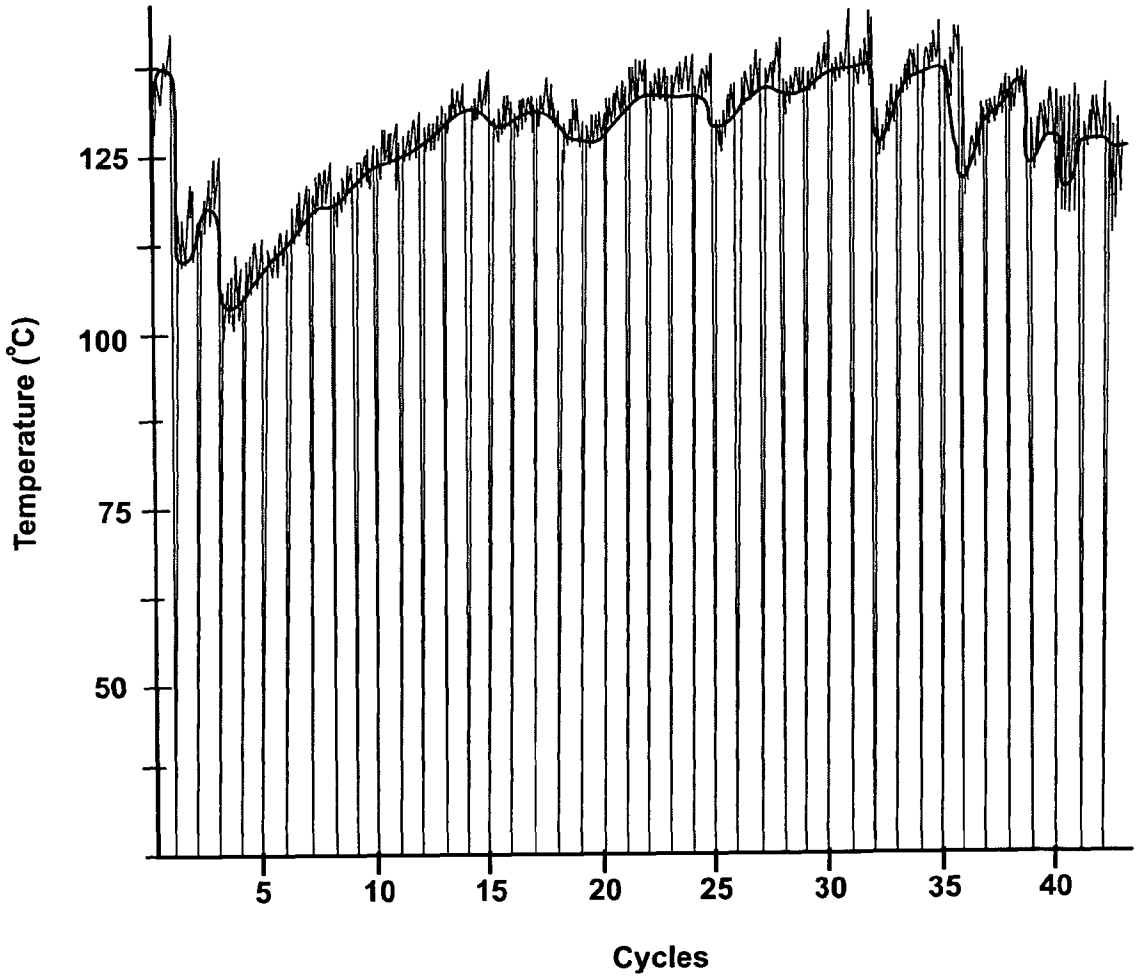
FIG. 12 is an exemplary graph of steam generator temperature as a function of time for forty-two operational cycles of the steam generator operating according to the method of FIG. 6.

The degree of calcification of the steam generator 60 may increase with increased usage, even with performing processes for cleaning the steam generator 60. Consequently, as the number of operational cycles for the steam generator 60 increases, the operational temperature range and the actual temperature tend to gradually increase, as illustrated in FIG. 11, which is a graph of the actual temperature over twenty-seven operational cycles, starting at the operational first cycle with a steam generator having little or no calcification. The line extending through all of the operational cycles represents a mean actual temperature, which increases as the number of operational cycles increases. Performing cleaning processes or otherwise reducing the calcification in the steam generator 60 may temporarily decrease the operating temperature range and the actual temperature, as seen in FIG. 12, which is a graph of the actual temperature over forty-two operational cycles, starting at the first operational cycle with a steam generator already having some calcification, as indicated by the relatively high actual temperature. The reduction of the actual temperature after cycles 1, 3, 25, 32, 36, 39, and 40 may be indicative of decreased calcification. Adjusting the operational temperature range according to the degree of calcification over the life of the steam generator 60 improves the steam generation efficiency of the steam generator 60.

While the control method described above includes adjusting the operational temperature range and the flow rate of water to the steam generator 60, it is possible to control the steam generator 60 without adjusting the flow rate of water. As already described, the behavior of the actual temperature is indicative of the calcification of the steam generator 60, and the operational temperature range may be set and reset based on the behavior of the actual temperature with a fixed flow rate of water. Although the performance of the steam generator 60 may not be as desirable as when controlled by the method involving changing the flow rate of water, the modified method may still be beneficial as the steam generation efficiency may be improved because the operation of the steam generator 60 is responsive to changes in calcification.

The methods described above for operating the steam generator 60 may be utilized in various types of fabric treatment appliances having various types of steam generators and are not limited for use with the washing machine 10 and the steam generator 60 described above and shown in the figures.

While the invention has been specifically described in connection with certain specific embodiments thereof, it is to be understood that this is by way of illustration and not of limitation, and the scope of the appended claims should be construed as broadly as the prior art will permit.

What is claimed is:

1. A method of controlling an operation of a fabric treatment appliance having a steam generator for generating steam to supply to a treating chamber of the fabric treatment appliance, the method comprising:

supplying water to the steam generator;

generating steam in the steam generator by heating the steam generator to an operational temperature;

supplying the steam generated in the steam generator to the treating chamber;

determining a relative change in a calcification of the steam generator; and setting a relative change in the operational temperature for the steam generator corresponding to the determined relative change in the calcification of the steam generator.

2. The method according to claim 1 wherein the determining the relative change in the calcification of the steam generator comprises changing of a flow rate of water to the steam generator.

3. The method according to claim 2 wherein the changing of the flow rate of water comprises changing a duty cycle of water supplied to the steam generator.

4. The method according to claim 2 wherein the changing of the flow rate of water is responsive to an actual temperature of the steam generator.

5. The method according to claim 4 wherein the changing of the flow rate of water comprises changing the flow rate of water when the actual temperature of the steam generator reaches the operational temperature.

6. The method according to claim 5 wherein the operational temperature is a maximum operational temperature, and the changing of the flow rate of water comprises increasing the flow rate of water.

7. The method according to claim 6, further comprising resetting the maximum operational temperature when the actual temperature exceeds the maximum operational temperature with the flow rate of water increased to a predetermined flow rate of water.

8. The method according to claim 4 wherein the operational temperature is a minimum operational temperature, and the changing of the flow rate of water comprises decreasing the flow rate of water.

9. The method according to claim 8, further comprising resetting the minimum operational temperature when the actual temperature reaches the minimum operational temperature with the flow rate of water decreased to a predetermined flow rate of water.

10. The method according to claim 1 wherein the operational temperature comprises an operational temperature range having a maximum operational temperature and a minimum operational temperature.

11. The method according to claim 10, further comprising changing a flow rate of water to the steam generator when an actual temperature of the steam generator reaches the maximum operational temperature.

12. The method according to claim 11 wherein the changing of the flow rate of water to the steam generator comprises increasing the flow rate of water when the actual temperature reaches the maximum operational temperature.

13. The method according to claim 11, further comprising resetting at least one of the maximum and minimum operational temperatures when the actual temperature crosses at least one of the maximum and minimum operational temperatures and the flow rate has been changed to at least one of a maximum and minimum flow rate, respectively.

14. The method according to claim 1, further comprising changing of a flow rate of water to the steam generator to attempt to control an actual temperature of the steam generator relative to the operational temperature.

15. The method according to claim 14, further comprising resetting the operational temperature when the actual temperature crosses the operational temperature and the flow rate has been changed to a predetermined flow rate.

16. The method according to claim 15 wherein the predetermined flow rate is at least one of a maximum and minimum flow rate.

* * * * *